US007075528B2

(12) United States Patent
Sano et al.

(10) Patent No.: US 7,075,528 B2
(45) Date of Patent: Jul. 11, 2006

(54) DISPLAY PANEL DRIVE CIRCUIT AND PLASMA DISPLAY

(75) Inventors: Yuji Sano, Kawasaki (JP); Toyoshi Kawada, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 69 days.

(21) Appl. No.: 10/282,115

(22) Filed: Oct. 29, 2002

(65) Prior Publication Data

US 2003/0141823 A1 Jul. 31, 2003

(30) Foreign Application Priority Data

Jan. 31, 2002 (JP) ..... 2002-024493

(51) Int. Cl.
*G09G 5/00* (2006.01)

(52) U.S. Cl. ..... 345/211; 315/169.1

(58) Field of Classification Search .. 315/169.1–169.4, 315/167; 345/60–70, 207–209, 84–92, 204, 345/211, 168

See application file for complete search history.

(56) References Cited

U.S. PATENT DOCUMENTS

| | | | | |
|---|---|---|---|---|
| 3,594,610 | A * | 7/1971 | Evans et al. | 345/76 |
| 5,081,400 | A | 1/1992 | Weber et al. | 315/169.4 |
| 5,721,472 | A * | 2/1998 | Browning et al. | 315/169.1 |
| 5,828,353 | A | 10/1998 | Kishi et al. | 345/55 |
| 5,838,289 | A | 11/1998 | Saito et al. | 345/79 |
| 5,872,561 | A * | 2/1999 | Figie et al. | 345/168 |
| 6,243,066 | B1 | 6/2001 | Murakami et al. | 345/98 |
| 6,515,644 | B1 * | 2/2003 | Kim | 345/87 |
| 6,534,925 | B1 * | 3/2003 | Kawashima | 315/169.1 |
| 6,559,815 | B1 * | 5/2003 | Kang et al. | 345/60 |
| 6,677,923 | B1 * | 1/2004 | Kajihara et al. | 345/89 |
| 6,873,309 | B1 * | 3/2005 | Suzuki et al. | 345/76 |

FOREIGN PATENT DOCUMENTS

| | | |
|---|---|---|
| CN | 367479 | 8/1999 |
| EP | 0 261 584 | 3/1988 |
| EP | 0 762 373 | 3/1997 |
| EP | 0 837 443 | 4/1998 |
| EP | 0 896 316 | 2/1999 |
| EP | 1 065 650 | 1/2001 |
| JP | 5-249916 | 9/1993 |
| JP | 7-261699 | 10/1995 |
| JP | 2000-181401 | 6/2000 |

OTHER PUBLICATIONS

European Search Report dated Mar. 15, 2005 of EP Application No. 02257482.

H. Sakuma et al., "An ac-Refresh Panel with High-Voltage CMOS Drivers and Unbalanced Power Supplies", XP 000573829, Jun. 5, 1984.

* cited by examiner

*Primary Examiner*—Wilson Lee
(74) *Attorney, Agent, or Firm*—Staas & Halsey LLP

(57) ABSTRACT

A display panel drive circuit having a plurality of first and second electrodes for connecting to a display panel, a first drive circuit for driving the first electrodes, and a second drive circuit for driving the second electrodes. The second drive circuit is connected to drive all or a part of a plurality of the second electrodes, or interrupted to increase output impedance.

13 Claims, 21 Drawing Sheets

DISPLAY PANEL DRIVE CIRCUIT AND PLASMA DISPLAY

CROSS-REFERENCE TO RELATED APPLICATIONS

This application is based upon and claims priority of Japanese Patent Application No. 2002-024493, filed on Jan. 31, 2002, the contents being incorporated herein by reference.

BACKGROUND OF THE INVENTION

1. Field of the Invention

The present invention relates to a circuit for driving a display panel, particularly to a circuit configuration capable of reducing power consumption in driving a display panel for a plasma display, an electroluminescence display, a liquid crystal display (LCD), or the like, as a capacitive load, and relates to a display device to which the drive circuit is applied.

2. Description of the Related Art

FIG. 15 is a block diagram schematically showing a three-electrode surface-discharge plasma display panel of an AC drive type, and FIG. 16 is a cross sectional view for explaining the electrode structure of the plasma display panel shown in FIG. 15. In FIG. 15 and FIG. 16, the reference numeral 207 denotes discharge cells (display cells), 210 a rear glass substrate, 211 and 221 dielectric layers, 212 phosphors, 213 barrier ribs, 214 address electrodes (A1 to Ad), 220 a front glass substrate, and 222 X electrodes (X1 to XL) or Y electrodes (Y1 to YL), respectively. Note that the reference symbol Ca shows capacitances between adjacent electrodes in the address electrodes, and Cg shows capacitances between opposing electrodes (the X electrodes and the Y electrodes) in the address electrodes 214.

A plasma display panel 201 is composed of two glass substrates, the rear glass substrate 210 and the front glass substrate 220. In the front glass substrate 220, the X electrodes (X1, X2, to XL) and the Y electrodes (scan electrodes: Y1, Y2, to YL) constituted as sustain electrodes (including BUS electrodes and transparent electrodes) are disposed.

In the rear glass substrate 210, the address electrodes (A1, A2, to Ad) 214 are disposed perpendicularly cross the sustain electrodes (the X electrodes and the Y electrodes) 222. Each of the display cells 207 generating discharge light-emission by these electrodes is formed in a region which is sandwiched by the X electrode and the Y electrode, namely the sustain electrodes, assigned the same number (Y1-X1, Y2-X2, . . . ) and which intersects the address electrode.

FIG. 17 is a block diagram showing an overall configuration of a plasma display device using the plasma display panel shown in FIG. 15. It shows an essential part of a drive circuit for the display panel.

As shown in FIG. 17, the three-electrode surface-discharge plasma display panel of the AC drive type is composed of the display panel 201 and a control circuit 205 which generates control signals for controlling the drive circuit for the display panel by an interface signal which is inputted from the outside. The three-electrode surface-discharge plasma display device of the AC drive type is also composed of an X common driver (an X electrode drive circuit) 206, a scan electrode drive circuit (a scan driver) 203, a Y common driver 204, and an address electrode drive circuit (an address driver) 202, which are to drive panel electrodes by the control signals from the control circuit 205.

The X common driver 206 generates a sustain voltage pulse. The Y common driver 204 also generates a sustain voltage pulse. The scan driver 203 independently drives and scans each of the scan electrodes (Y1 to YL). The address driver 202 applies an address voltage pulse corresponding to display data to each of the address electrodes (A1 to Ad).

The control circuit 205 includes a display data control part 251 which receives a clock CLK and display data DATA and supplies an address control signal to the address driver 202, a scan driver control part 253 which receives a vertical synchronization signal Vsync and a horizontal synchronization signal Hsync and controls the scan driver 203, and a common driver control part 254 which controls the common drivers (the X common driver 206 and the Y common driver 204). Incidentally, the display data control part 251 includes a frame memory 252.

FIG. 18 is a chart showing examples of drive waveforms of the plasma display device shown in FIG. 17. It schematically shows waveforms of applied voltages to the respective electrodes, mainly in a total write period (AW), a total erase period (AE), an address period (ADD), and a sustain period (a sustain discharge period: SUS).

In FIG. 18, drive periods directly involved in image display are the address period ADD and the sustain period SUS. A pixel to be displayed is selected in the address period ADD, and the selected pixel is caused to sustain light emission in the next sustain period so that an image is displayed with a predetermined brightness. Note that FIG. 18 shows the drive waveforms in each sub-frame when one frame consists of a plurality of the sub-frames (sub-fields).

First, in the address period ADD, an intermediate potential −Vmy is synchronously applied to all the Y electrodes (Y1 to YL) which are the scan electrodes. Thereafter, the intermediate potential −Vmy is changed over to a scan voltage pulse on −Vy level, which is applied to the Y electrodes (Y1 to YL) in sequence. At this time, an address voltage pulse on +Va level is applied to each of the address electrodes (A electrodes: A1 to Ad) in synchronization with the application of the scan pulse to each of the Y electrodes, thereby performing pixel selection on each scan line.

In the subsequent sustain period SUS, a common sustain voltage pulse on +Vs level is alternately applied to all of the scan electrodes (Y1 to YL) and the X electrodes (X1 to XL), thereby allowing the pixel which is previously selected to sustain the light emission. By this successive application, the display with a predetermined brightness is performed. Further, when the number of times of the light emissions is controlled by combining a series of the basic operations of the drive waveforms as described above, it is also made possible to display the tone of shading.

Here, the total write period AW is a period in which a write voltage pulse is applied to all of the display cells of the panel to activate each of the display cells and keep their display characteristics uniform. The total write period AW is inserted at a regular cycle. The total erase period AE is a period in which an erase voltage pulse is applied to all the display cells of the panel before an address operation and a sustain operation for image display are newly started, thereby erasing previous display contents.

FIG. 19 is a block circuit diagram showing one example of an IC which is used for the plasma display device shown in FIG. 17.

For example, when the display panel has 512 Y electrodes (Y1 to YL) and a drive IC connected to the Y electrode has 64 bit outputs, totally eight drive ICs are used. In general, the eight drive ICs are divided and mounted on a plurality of modules, on each of which a plurality of the ICs are mounted.

FIG. 19 shows a circuit configuration inside a drive IC chip 230 having output circuits (234: OUT1 to OUT64) for 64 bits. Each of the output circuits 234 is constituted in a manner that a high voltage power supply wire VH and a ground wire GND are connected with push-pull type FETs 2341 and 2342 of a final output stage therebetween. This drive IC 230 further has logic circuits 233 for controlling both of the FETs, a shift register circuit 231 for selecting the output circuits for 64 bits, and a latch circuit 232.

Their control signals are composed of a clock signal CLOCK and a data signal DATA for the shift register 231, a latch signal LATCH for the latch circuit 232, and a strobe signal STB for controlling gate circuits. The final output stage has a CMOS configuration (2341 and 2342) in FIG. 19, but a totempole configuration composed of MOSFETs having the same polarity can be also applied.

Next, an example of a method of mounting the above-described drive IC chip will be explained. For example, the drive IC chips are mounted on a rigid printed substrate, and pad terminals for a power supply, signals, and outputs of the drive IC chips and corresponding terminals on the printed substrate are connected by wire bonding.

Output wires from the IC chips are drawn out to an end surface side of the printed substrate to form output terminals. The output terminals are connected by thermocompression bonding to a flexible substrate, on which the same terminals are provided, to form one module. At a tip of this flexible substrate, a terminal for connection to panel display electrodes is provided. The terminal is connected to the panel display electrodes for use by a method such as thermocompression.

All of drive terminals of the respective electrodes described above, except dummy electrodes in an end part of the panel, are insulated from the ground potential of the circuits in terms of direct current, and capacitive impedance is dominant as a load of the drive circuits. A power recovery circuit to which energy transfer between a load capacitance and an inductance by a resonant phenomenon is applied is known as a technology for lowering power consumption of a pulse drive circuit of a capacitive load. A low power drive circuit described in Japanese Patent Laid-Open No. 5-249916 shown in FIG. 20 is an example of the power recovery circuit suitable for the drive circuit such as the address electrode drive circuit, in which the load capacitance greatly changes in order to drive individual load electrodes by the voltages independent of each other in accordance with a display image.

In the conventional example shown in FIG. 20, a power supply terminal 121 of an address drive IC 120 is driven through the use of a power recovery circuit 110 having resonant inductances 112P and 112N so that power consumption is reduced. The power recovery circuit 110 outputs a normal constant address drive voltage at the timing when address discharge is induced in the address electrodes of the plasma display panel. Then, a voltage of the power supply terminal 121 is lowered to the ground level before switching states of output circuits 122 in the address drive IC are changed over. At this time, resonance is generated between the resonant inductances 112P and 112N in the power recovery circuit 110 and a combined load capacitance (for example, CL×n at the largest) of any number (for example, n at the largest) of the address electrodes, which are being driven at high level, so that power consumption in output elements of the output circuits 122 in the address drive IC is greatly reduced.

In the conventional drive method in which the power supply voltage of the address drive IC is kept constant, the entire amount of change in stored energy in the load capacitance CL before and after the switching is consumed in a resistive impedance part in a charge/discharge current path. When the power recovery circuit 110 is used, a potential energy amount stored in the load capacitance with an intermediate potential of the address drive voltage, which is a resonant center of an output voltage, as a reference is maintained via the resonant inductances 112P and 112N of the power recovery circuit 110. After the switching states of the output circuits are changed over while the power supply voltage is at the ground, the power supply voltage of the address drive IC is raised again to the normal constant drive voltage through resonance so that power consumption is reduced.

Moreover, another technology for lowering power consumption of the pulse drive circuit of the capacitive load is a capacitive load drive circuit described in unpublished Japanese Patent Application No. 2000-301015 shown in FIG. 21. In this circuit, power is distributed to a power distributor 30 composed of a resistance and a constant current circuit to reduce power consumption of a drive element 6 in a drive circuit 3. This is based on a principle that a drive current flowing through the drive element 6 is also sent to the power distributor 30 connected in series so that power consumption is distributed at a sharing ratio corresponding to a voltage dividing ratio therebetween. Further, by raising and lowering a drive power supply 1 by n stages, supplied power from the drive power supply 1 to the drive circuit 3 and power consumption of each part in the drive circuit 3 can be also reduced to one-nth. In comparison to the power recovery technology described above, it is not necessary to induce the resonant phenomenon showing a high Q, and therefore a large load capacitance 5 can be driven at a high speed while reducing power consumption of the drive element 6 in the drive circuit 3 at the same level, which brings about an advantage that circuit costs can be substantially cut.

The conventional drive circuit shown in FIG. 20 described above intends to reduce power consumption through the use of the resonant phenomenon, but there is a problem that an effect of reducing power consumption is greatly lost as the recent plasma display panel has higher resolution and larger size. If an output frequency of the drive circuit is increased in response to the higher resolution, time for the afore-said resonance needs to be shortened in order to maintain control performance of the plasma display panel. At this time, only values of the resonant inductances provided in the power recovery circuit need to become smaller, which decreases the effect of power reduction due to decrease in Q of the resonance. Further, even if a parasitic capacitance of the address electrodes is increased as the screen becomes larger, the aforesaid effect of power reduction is decreased because of the decrease in the resonant inductance values described above in order to prevent the afore-mentioned resonant time from increasing. Furthermore, as the output frequency of the drive circuit is increased, the number of times the plasma display panel is driven by a high-voltage pulse is also increased, which increases power consumption and causes a big problem of heating in the drive circuit (the drive IC).

Also in the capacitive load drive circuit shown in FIG. 21, in which a power distribution method is used, if the supplied power from the drive power supply 1 to the drive circuit 3 can be further decreased, heating in the overall system including the power supply circuit can be reduced, which enables further cost reduction.

If power consumption of the drive circuit 3 cannot be reduced sufficiently, heatsinking costs and parts costs of each part in the display are increased. Further, there may arise a case in which light-emission brightness is restricted by heatsinking limitation of the display device itself or downsizing as an advantage of a flat panel display is not realized sufficiently.

SUMMARY OF THE INVENTION

In consideration of the above-described problems of the prior art, it is an object of the present invention to provide a display panel drive circuit which is capable of reducing power consumption (heating) in the drive circuit as well as preventing costs of each part of the display from increasing, and to provide a display device using the display panel drive circuit.

According to one aspect of the present invention, provided is a display panel drive circuit comprising: a plurality of first electrodes and second electrodes for connecting to a display panel; a first drive circuit for driving the first electrodes; and a second drive circuit for driving the second electrodes. The second drive circuit is connected for driving all or a part of a plurality of the second electrodes or interrupted to increase output impedance.

All or a part of the second electrodes are controlled to an interruption state so that a parasitic capacitance existing in the display panel can be removed from a load capacitance of the first drive circuit. With this effect of reducing the load capacitance, power consumption of the first circuit can be reduced.

According to another aspect of the present invention, provided is a display panel drive circuit comprising: a power supply capable of supplying a voltage; an output terminal for outputting a voltage supplied from the power supply; and a first switching element connected between the power supply and the output terminal, capable of bi-directional conduction, and having a switching function for a current of at least one direction.

Since the first switching element has the switching function for the current of at least one direction and the bi-directional conducting function, the number of the switching elements can be reduced, thereby reducing circuit costs.

According to still another aspect of the present invention, provided is a display panel drive circuit comprising: a common switching element connected to a power supply; first and second switching elements connected in series between the power supply and a reference potential via the common switching element; a first output terminal connected between the first and second switching elements; third and fourth switching elements connected in parallel to the first and second switching elements and in series between the power supply and the reference potential via the common switching element; a second output terminal connected between the third and fourth switching elements; and a control circuit. The control circuit opens the common switching element, outputs a voltage of the second output terminal from the first output terminal via the first and third switching elements, and thereafter outputs a voltage of the power supply from the first output terminal via the common switching element and the first switching element.

With the control by the control circuit, electric charge charged in a load capacitance connected to the second output terminal can be reused when output is changed over from the second output terminal to the first output terminal. This reduces energy supplied from the power supply when the output is changed over, thereby lowering power consumption.

According to yet another aspect of the present invention, provided is a display panel drive circuit comprising: a power supply capable of supplying a voltage; a first switching element connected to the power supply; a plurality of output terminals capable of outputting the voltage of the power supply via the first switching element; a plurality of second switching elements connected between the power supply and a plurality of the output terminals respectively; and a resonant circuit. The resonant circuit is provided for each one or plurality of the second switching elements out of a plurality of the second switching elements and includes a resonant inductance and a capacitor connectable to a reference potential, and the larger number of the resonant circuits than that of the first switching element are provided.

The resonant circuit is provided for each one or plurality of the second switching elements so that wire length of the resonant circuit is shortened and parasitic inductance of a resonant current path can be reduced. This realizes high-speed drive with a reduced resonance cycle and reduction in power consumption as a result of improvement in power recovery efficiency due to increase in the Q value. Further, by reducing the number of the first switching element having small effects on resonance, circuit costs can be reduced.

DETAILED DESCRIPTION OF THE PREFERRED EMBODIMENTS

First Embodiment

Figure 1:
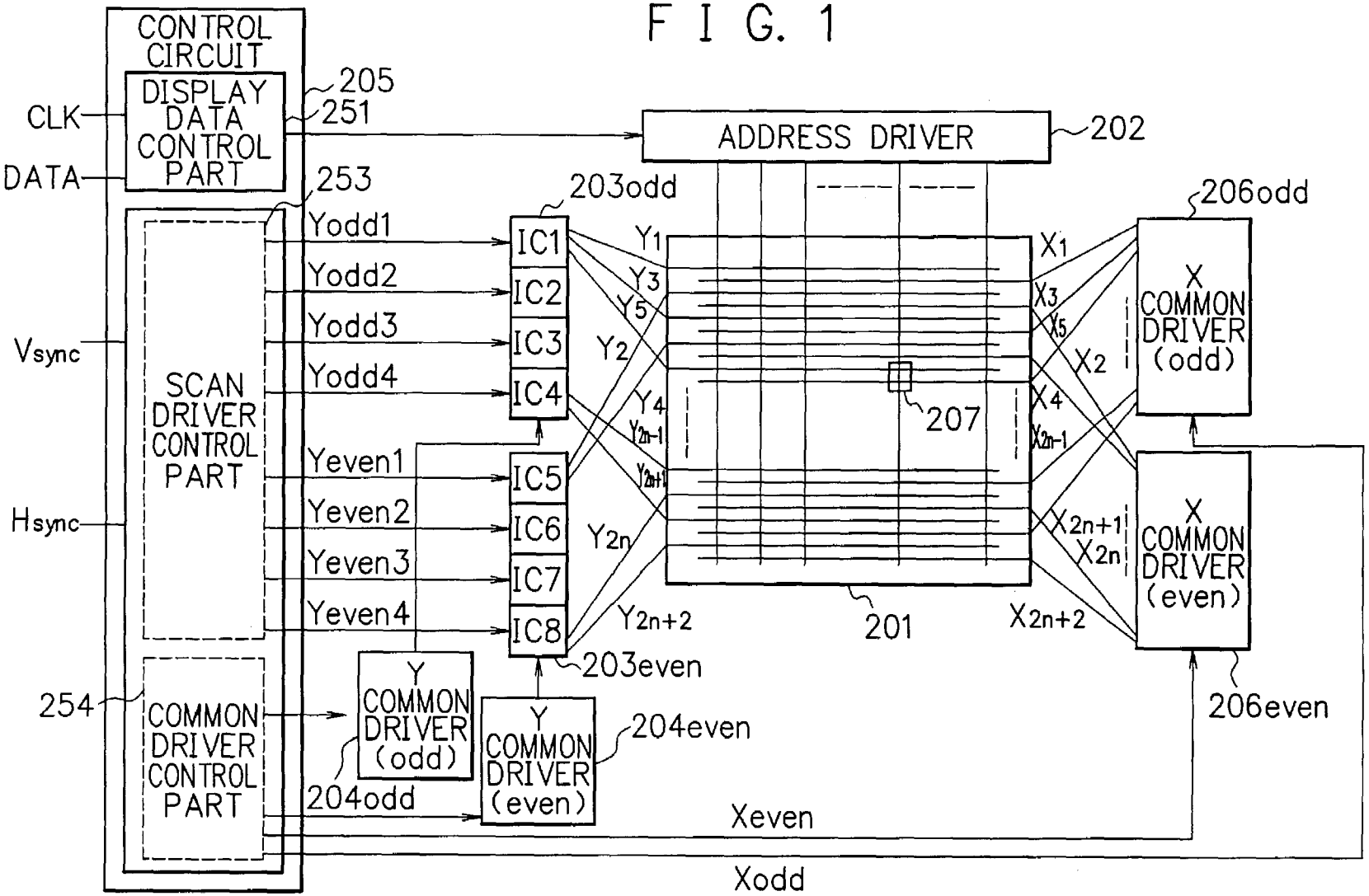
FIG. 1 shows a block diagram showing a plasma display according to a first embodiment of the present invention.

FIG. 1 shows a block diagram of an overall configuration of a plasma display device according to a first embodiment of the present invention. This plasma display device can reduce a load capacitance of a panel drive circuit. This plasma display device is composed of a plasma display panel 201, a control circuit 205 which forms a control signal for controlling a drive circuit of the display panel by an interface signal which is inputted from the outside, X common drivers (X electrode drive circuits) 206odd and 206even, scan electrode drive circuits (scan drivers) 203odd and 203even, Y common drivers 204odd and 204even for driving panel electrodes by the control signal from the control circuit 205, and an address electrode drive circuit (address driver) 202.

The X common drivers 206odd and 206even generate a sustain voltage pulse. The Y common drivers 204odd and 204even also generate a sustain voltage pulse. The scan drivers 203odd and 203even independently drive and scan each of scan electrodes (Y1 to YL). The address driver 202 applies an address voltage pulse corresponding to display data to each of address electrodes (A1 to Ad).

The control circuit 205 includes a display data control part 251, a scan driver control part 253, and a common driver control part 254. The display data control part 251 receives a clock CLK and display data DATA and supplies an address control signal to the address driver 202. The scan driver control part 253 receives a vertical synchronization signal Vsync and a horizontal synchronization signal Hsync and controls the scan drivers 203odd and 203even. The common driver control part 254 receives the vertical synchronization signal Vsync and the horizontal synchronization signal Hsync and controls the common drivers (the X common drivers 206odd and 206even and the Y common drivers 204odd and 204even). Incidentally, the display data control part 251 includes a frame memory.

Figure 15:
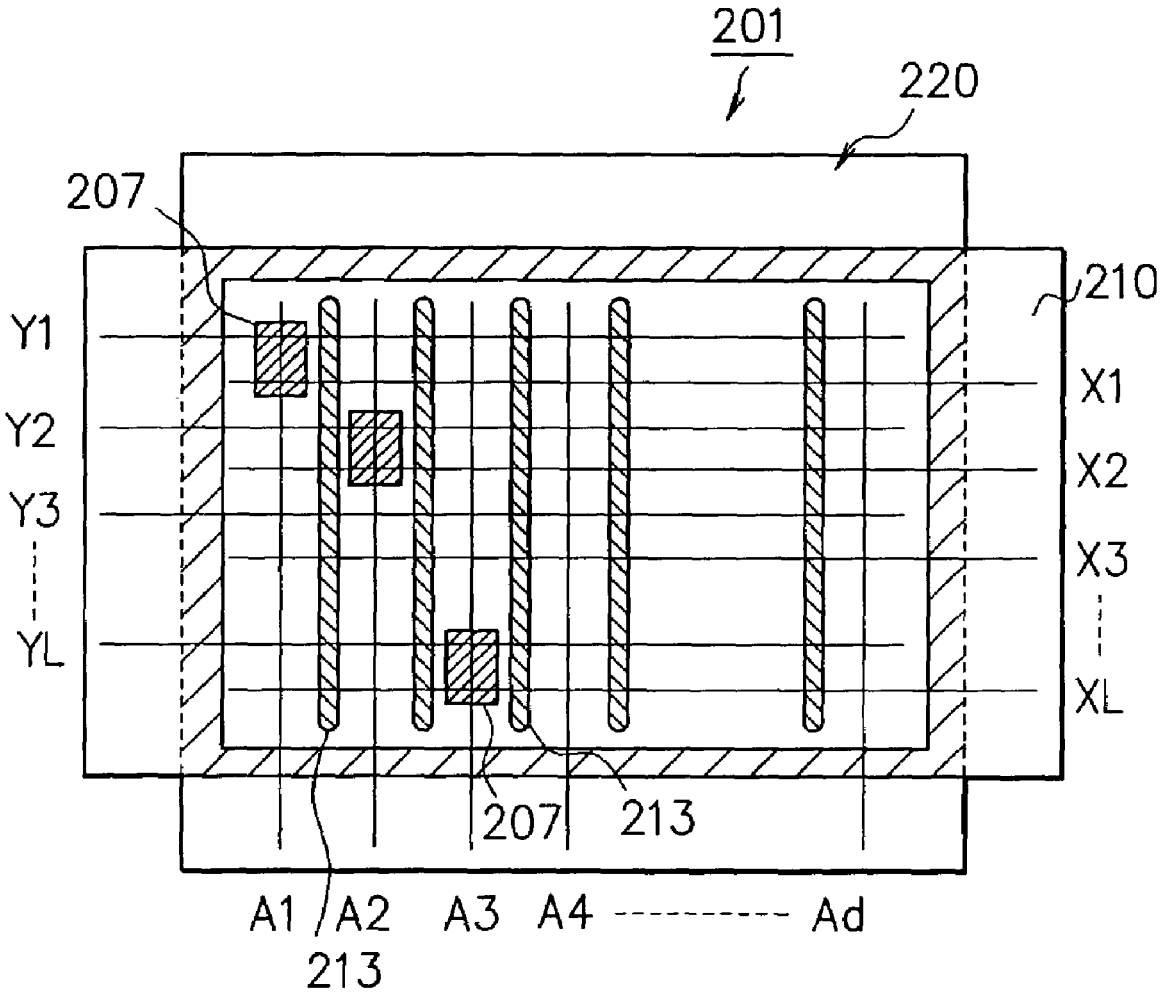
FIG. 15 is a flat schematic view of a surface-discharge plasma display panel of an AC drive type.
Figure 16:
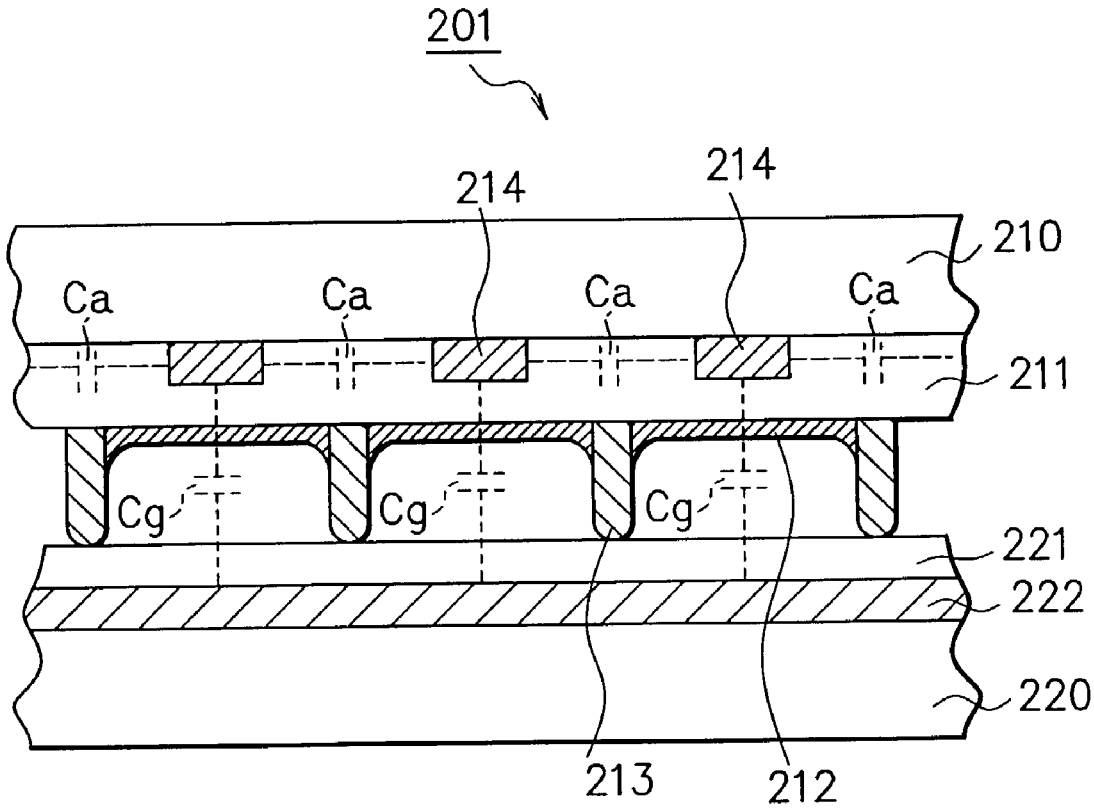
FIG. 16 is a cross-sectional schematic view of the surface-discharge plasma display panel of the AC drive type.
Figure 17:
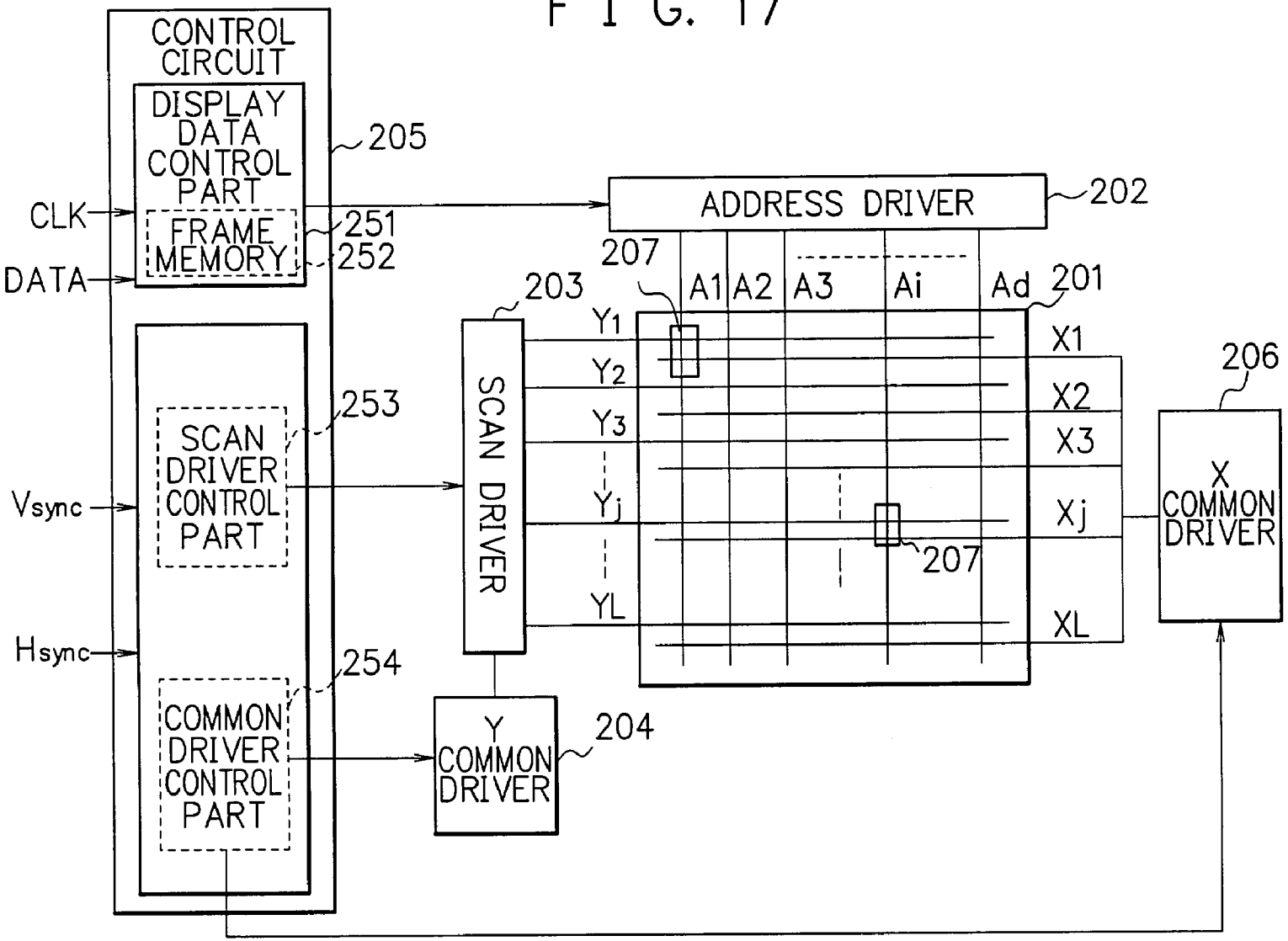
FIG. 17 is a block diagram showing a drive circuit for the surface-discharge plasma display panel of the AC drive type.

The plasma display panel 201 includes discharge cells (display cells) 207 and has the structure shown in FIG. 15 and FIG. 16. Drive waveforms of the plasma display device are the same as those shown in FIG. 18.

The scan drivers include the scan drive module 203odd for odd-numbered lines of the plasma display panel 201 and the scan drive module 203even for even-numbered lines. These scan drivers apply a scan pulse to the odd-numbered lines and the even-numbered lines separately in the address period ADD (FIG. 18) of a drive sequence to prevent a control malfunction of an address which is caused by interference between adjacent lines from occurring. For example, the scan pulse is transferred between the even-numbered lines immediately after the odd-numbered lines are scanned, and an output from the address driver 202 is synchronized with this operation. Moreover, in a case of FIG. 1, four scan drive ICs (IC1 to IC4 and IC5 to IC8) are mounted on the scan drive modules 203odd and 203even for the odd-numbered lines and the even-numbered lines respectively. Between the eight scan drive ICs, shift registers therein are connected in series to transfer a data signal corresponding to the scan pulse. Due to this operation, two types of the Y common drivers, the driver 204odd for the odd-numbered lines and the driver 204even for the even-numbered lines, become necessary. Similarly, two types of the X common drivers, the driver 206odd for the odd-numbered lines and the driver 206even for the even-numbered lines, become necessary.

In the drive circuits for the X electrodes and the Y electrodes, by interrupting drive elements therein, impedance is made high and a load capacitance of the address driver 202 is reduced so that power consumption can be lowered. For example, in the Y common drivers 204odd and 204even and the X common drivers 206odd and 206even, the drivers for the even-numbered lines are brought to a high output impedance state when the odd-numbered lines are addressed and the odd-numbered lines are brought to the high output impedance state when the even-numbered lines are addressed by controlling interruption of the drive elements. It is needless to say that the drive elements need to be properly controlled before and after they are brought to the high output impedance state described above in order to control drive potentials of the targeted X electrodes and Y electrodes.

However, at the timing when an output of the address driver 202 changes over, it is preferable that the X electrodes and the Y electrodes are possibly in the above-described high output impedance state. Accordingly, even in the driver for the odd-numbered or even-numbered lines including a line to which the scan pulse is being applied, their drive circuits are brought to the high impedance state for each of the lines to which the scan pulse is not being applied, or for each of the modules or flexible substrates including the line. The detail will be explained later with reference to FIG. 2.

Here, control signals Yodd1 to Yodd4 and Yeven1 to Yeven4 are inputted to the eight drive ICs which are mounted on the scan drivers 203odd and 203even shown in FIG. 1 so that the ICs can be controlled to the above-described high output impedance state for each of the ICs.

Figure 2:
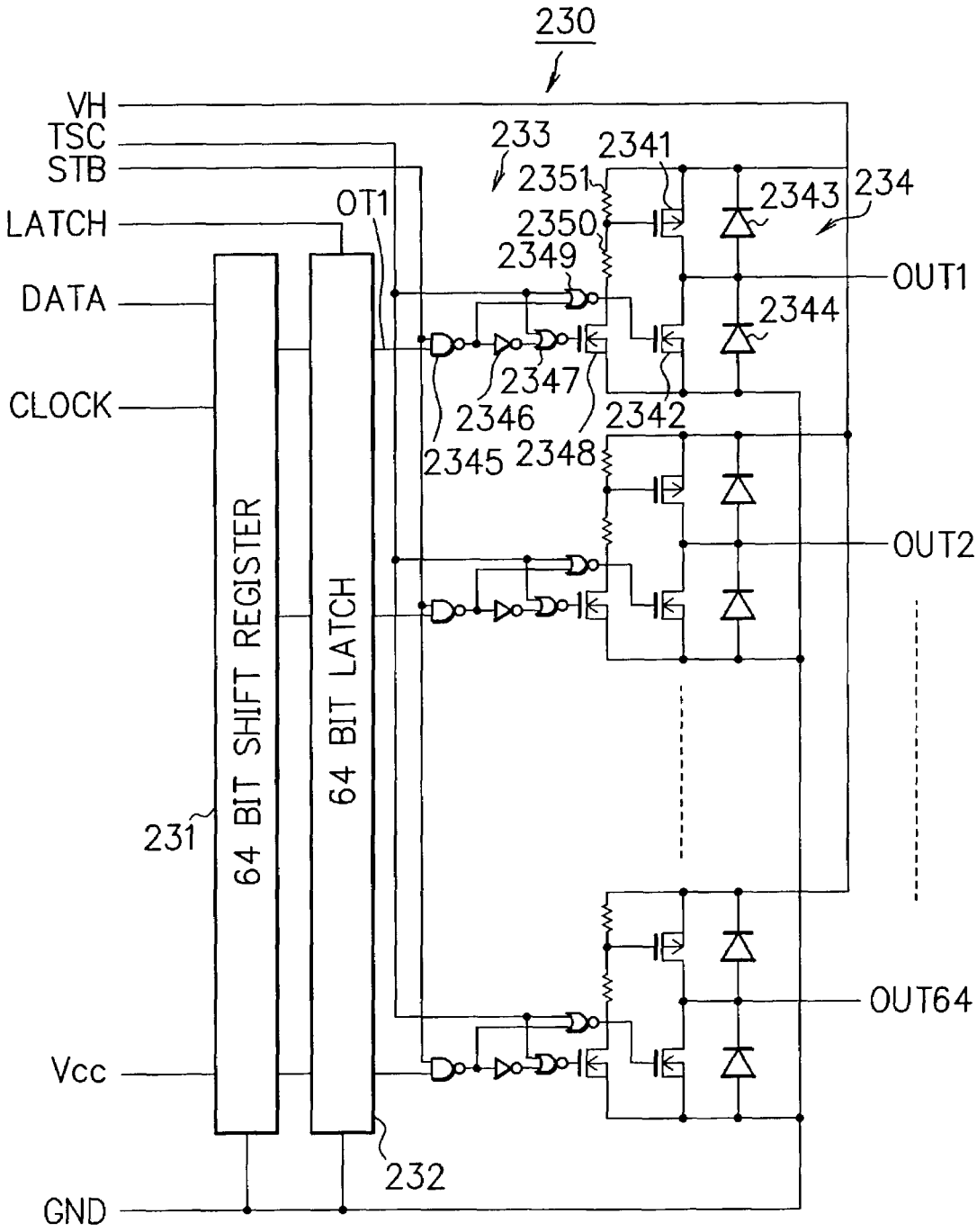
FIG. 2 is a circuit diagram showing a circuit configuration of a drive IC according to the first embodiment of the present invention.

FIG. 2 shows one example of a circuit diagram of an internal circuit of a drive IC 230 in the scan drivers 203odd and 203even. Circuit configurations of drive ICs in the X common drivers 206odd and 206even are the same as this. The drive IC 230 has output circuits 234 (OUT1 to OUT64) for 64 bits. The output circuits 234 are connected to a high voltage power supply VH and the ground GND with push-pull type FETs 2341 and 2342 of a final output stage therebetween. This drive IC 230 further has logic circuits 233 for controlling both FETs, a shift register circuit 231 for selecting the output circuits for 64 bits, and a latch circuit 232.

Their control signals are composed of a clock signal CLOCK and a data signal DATA for the shift register 231, a latch signal LATCH of the latch circuit 232, a power supply Vcc for the logic circuits, and a strobe signal STB and a tristate control signal TSC for controlling gate circuits.

The shift register 231 receives the data signal DATA and shifts it into data of 64 bits. The latch 232 latches an output of the shift register 231 and outputs data OT1 and the like of 64 bits.

A negative AND (NAND) circuit 2345 receives the output data OT1 and the strobe signal STB and outputs negative AND. A logical NOT (NOT) circuit 2346 outputs logical inversion data of the output of the NAND circuit 2345. A negative OR (NOR) circuit 2347 receives the output of the NOT circuit 2346 and the tristate control signal TSC and outputs negative OR. A NOR circuit 2349 receives the tristate control signal TSC and the output of the NAND circuit 2345 and output negative OR.

An n-channel MOS (metal oxide semiconductor) FET (field-effect transistor) 2348 has a gate connected to an output of the NOR circuit 2347 and a source connected to the ground GND. A resistance 2350 is connected between a drain of the n-channel MOSFET 2348 and a gate of the p-channel MOSFET 2341. A resistance 2351 is connected between the gate of the p-channel MOSFET 2341 and the high voltage power supply VH. The p-channel MOSFET 2341 has a source connected to the high voltage power supply VH and a drain connected to the output line OUT1. The n-channel MOSFET 2342 has a gate connected to an output of the NOR circuit 2349, a source connected to the ground GND, and a drain connected to the output line OUT1. A diode 2343 has an anode connected to the output line OUT1 and a cathode connected to the high voltage power supply VH. A diode 2344 has an anode connected to the ground GND and a cathode connected to the output line OUT1. Although one bit out of 64 bits has been explained above, circuits of other bits have the same configuration.

Figure 18:
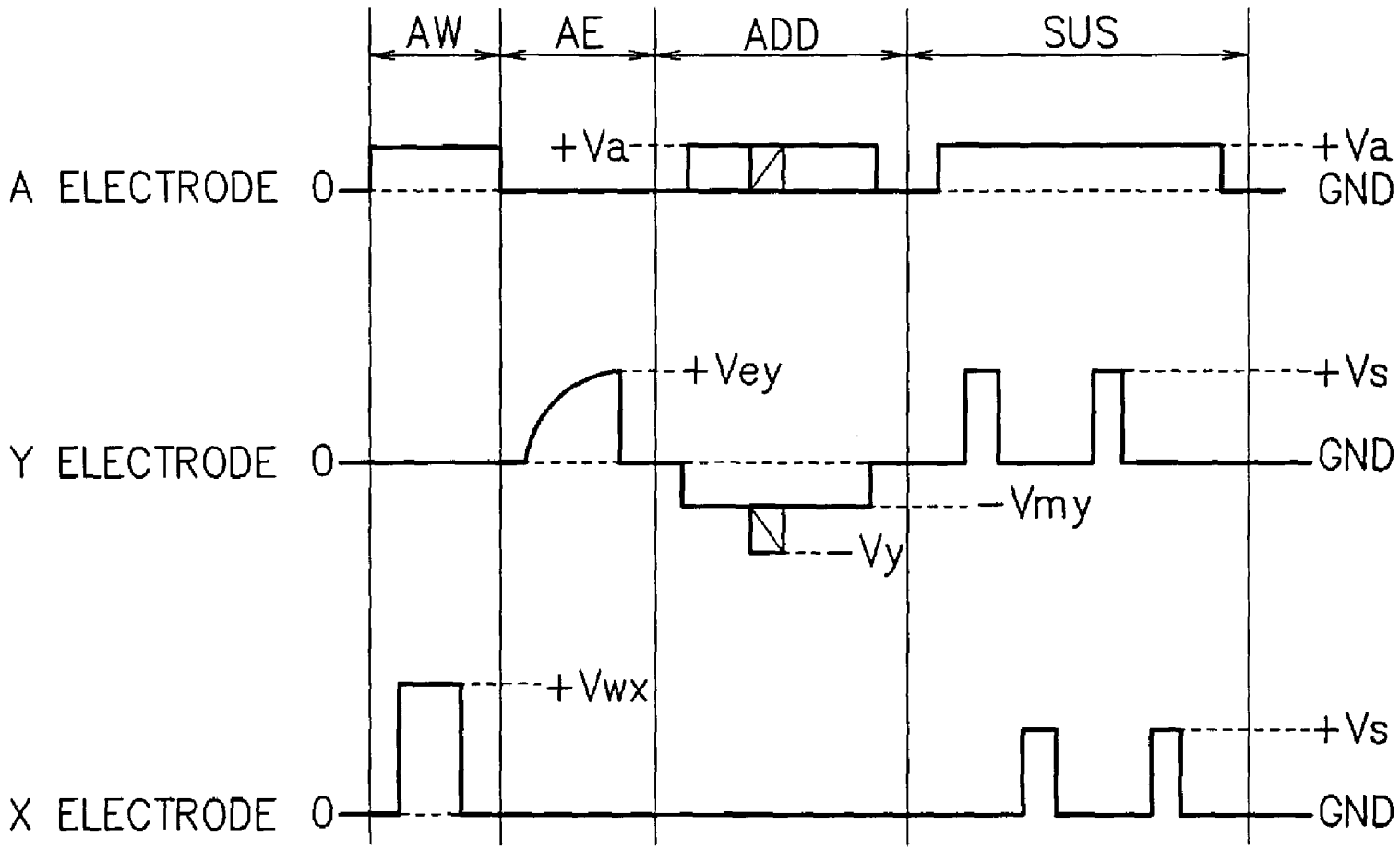
FIG. 18 is a waveform chart showing drive voltage waveforms of the surface-discharge plasma display panel of the AC drive type.
Figure 19:
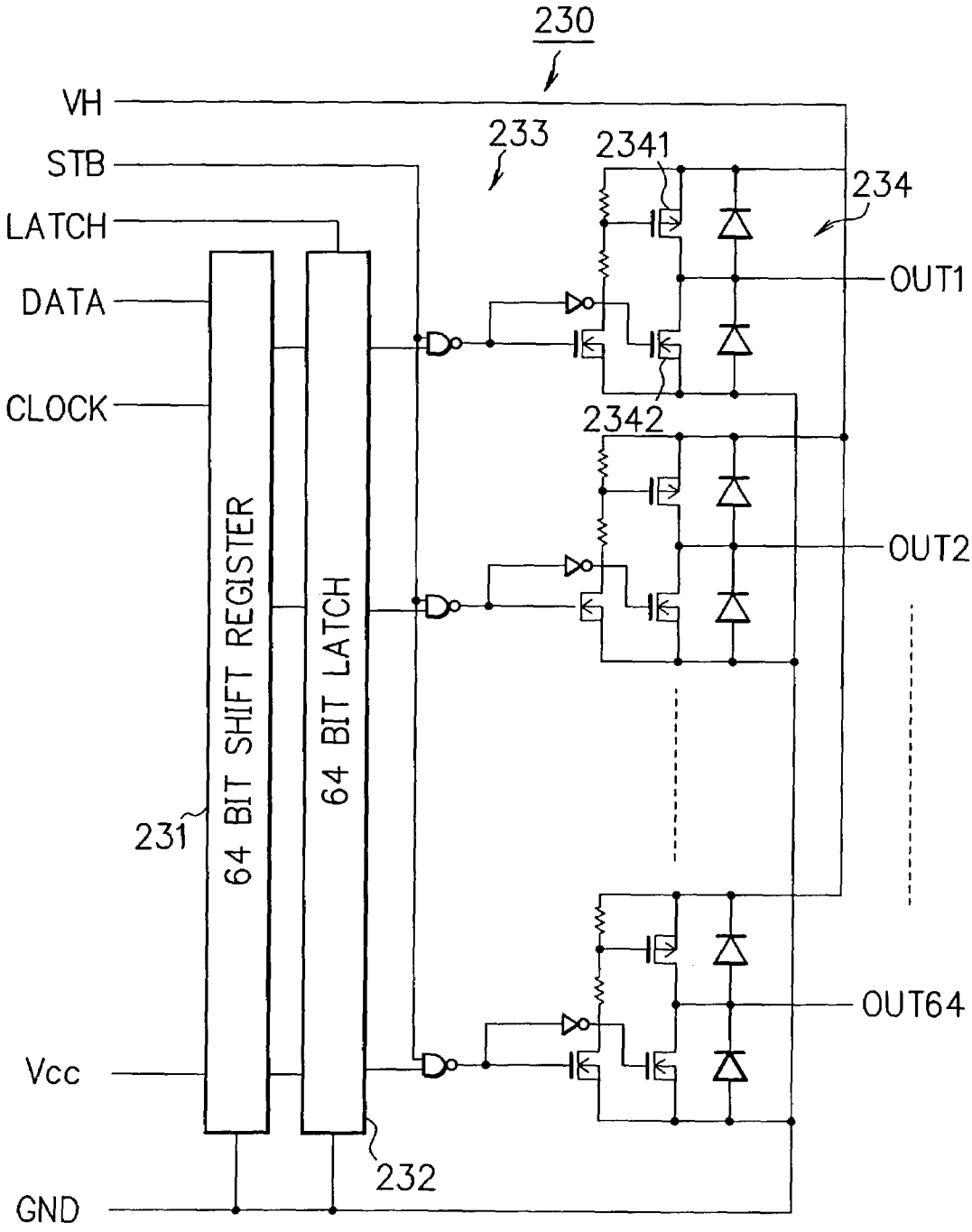
FIG. 19 is a circuit diagram showing a circuit configuration of a drive IC.
Figure 20:
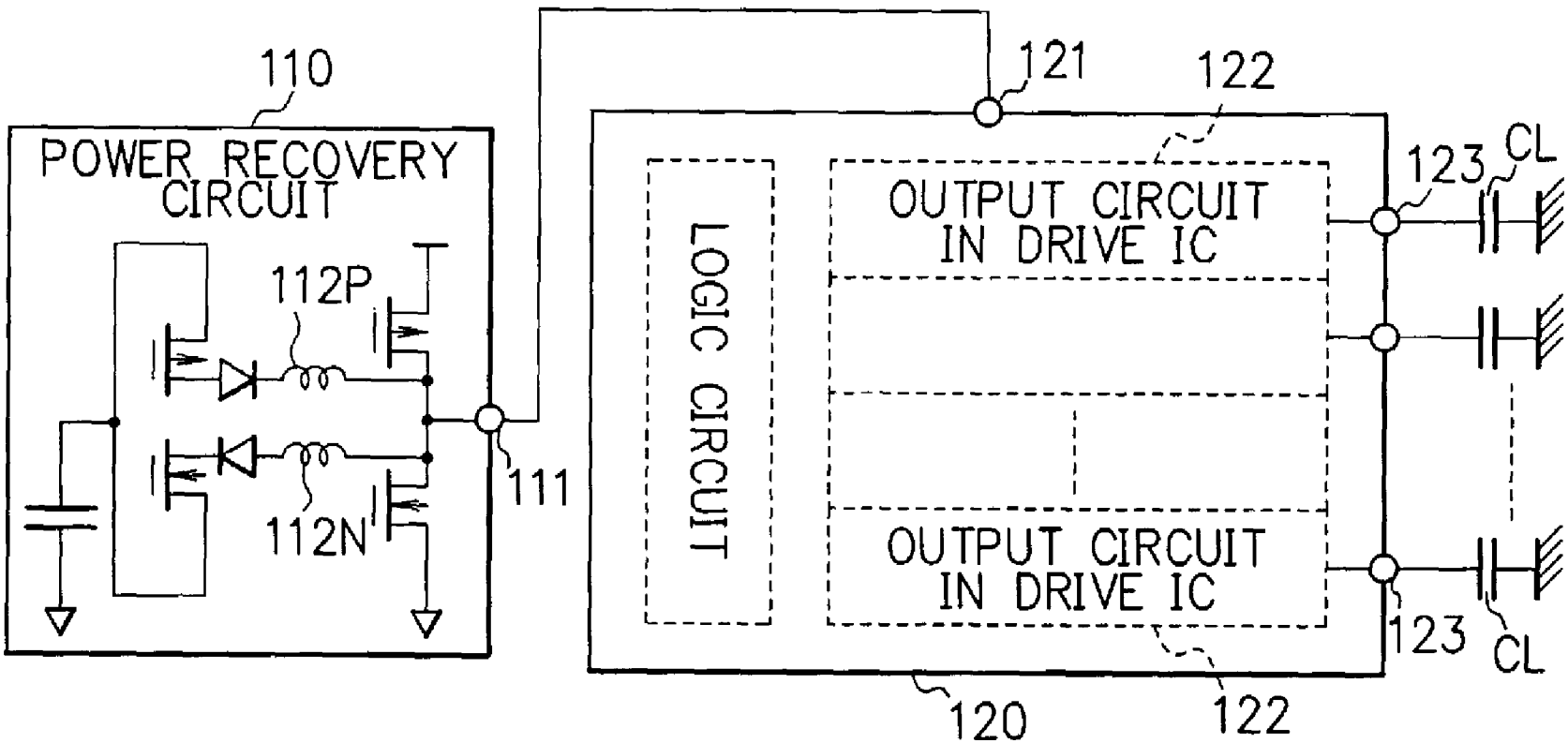
FIG. 20 PRIOR ART
FIG. 20 is a block diagram showing one example of a drive circuit for a conventional plasma display using a power recovery method.

When the drive waveforms shown in FIG. 18 are applied to the plasma display panel, the scan drivers are made to have high output impedance in the address period ADD. The X common drivers are also made to have high output impedance. However, the scan drivers and the X common drivers for lines to which the scan pulses are applied are driven at low output impedance.

The tristate control signal TSC is brought to high level, thereby interrupting both of the high-side drive element 2341 and the low-side drive element 2342 in each of circuit blocks. Therefore, if output impedance of the drive circuits is controlled for each of the scan drive modules 203odd and 203even, the tristate control signals TSC for all of the drive ICs mounted on each of the modules 203odd and 203even should be made common. In a case in which only the drive ICs, which are not driving the lines to which the scan pulses of the scan drivers 203odd and 203even are applied and their adjacent lines, are made to have the high output impedance described above, the tristate control signals TSC having different timings are inputted for each of the drive ICs.

Figure 3:
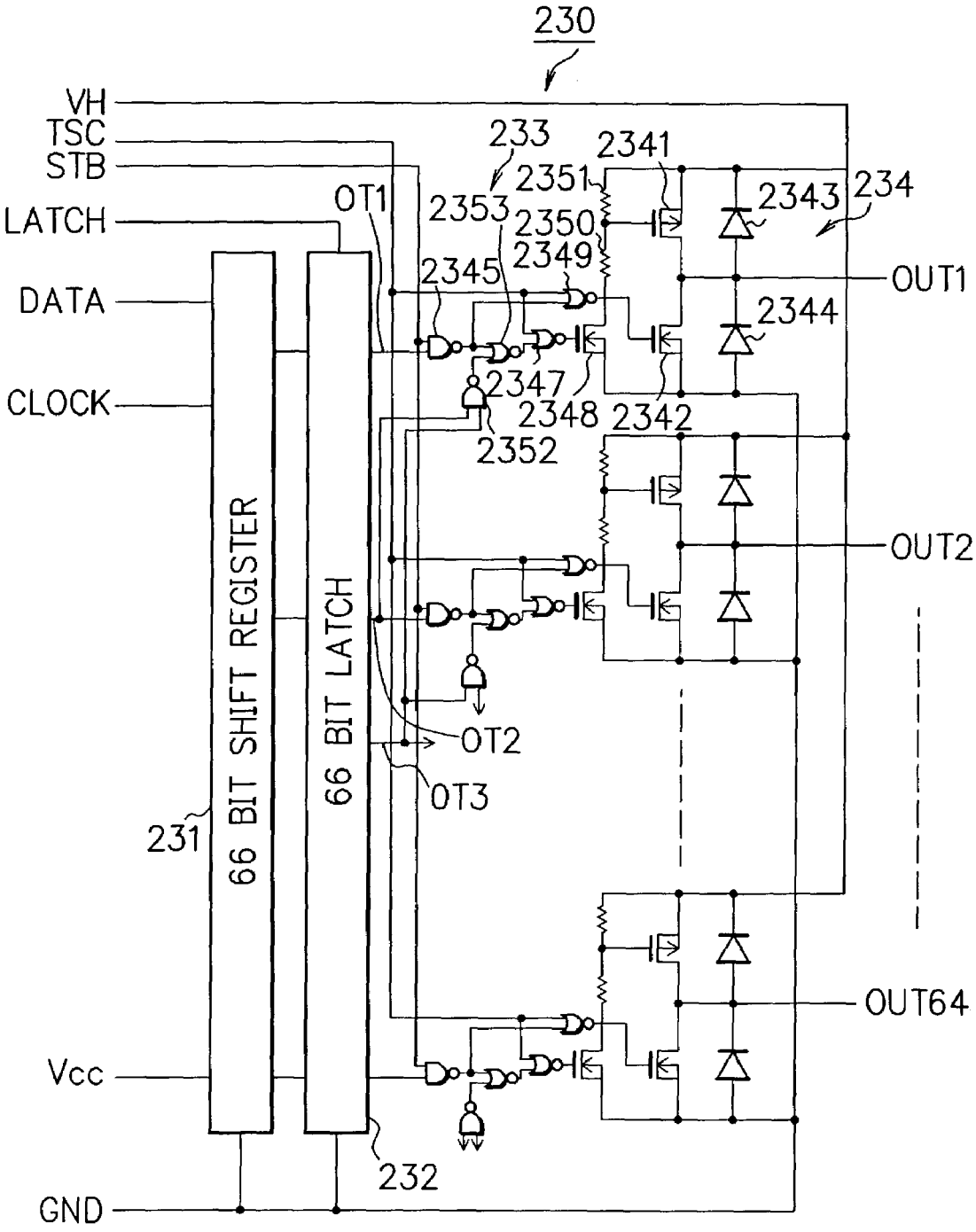
FIG. 3 is a circuit diagram showing another circuit configuration of the drive IC.

FIG. 3 shows another circuit example of the drive IC 230. In this drive IC 230, only the lines to which the scan pulses of the scan drivers 203odd and 203even are applied and their adjacent lines can be driven at low output impedance in order to reduce the load capacitance of the address driver 202 (FIG. 1) maximally. The points different from the circuit in FIG. 2 will be explained.

A shift register 231 is a shift register for 66 bits. A latch 232 is a latch for 66 bits. A NAND circuit 2352 receives output data OT2 and OT3 and outputs negative AND. A NOR circuit 2353 receives the output of the NAND circuit 2352 and an output of a NAND circuit 2345 and outputs negative OR. A NOR circuit 2347 receives the output of the NOR circuit 2353 and the tristate control signal TSC and outputs negative OR to a gate of a MOSFET 2348.

All the outputs are controlled to have high output impedance by the tristate control signal TSC as well as output terminals other than an output terminal of the scan pulse and its adjacent terminals are forcedly controlled to have high output impedance. One circuit example of the drive IC is shown in FIG. 3 in which only the output terminal of the scan pulse and at least one of its adjacent terminals can be made to have low output impedance. However, it is needless to say that those in the art can easily find a method of realizing this function other than the circuit example shown in FIG. 3, such as using a sequential circuit in the control circuit for the drive elements or adding a shift register corresponding to an output impedance state.

Figure 4:
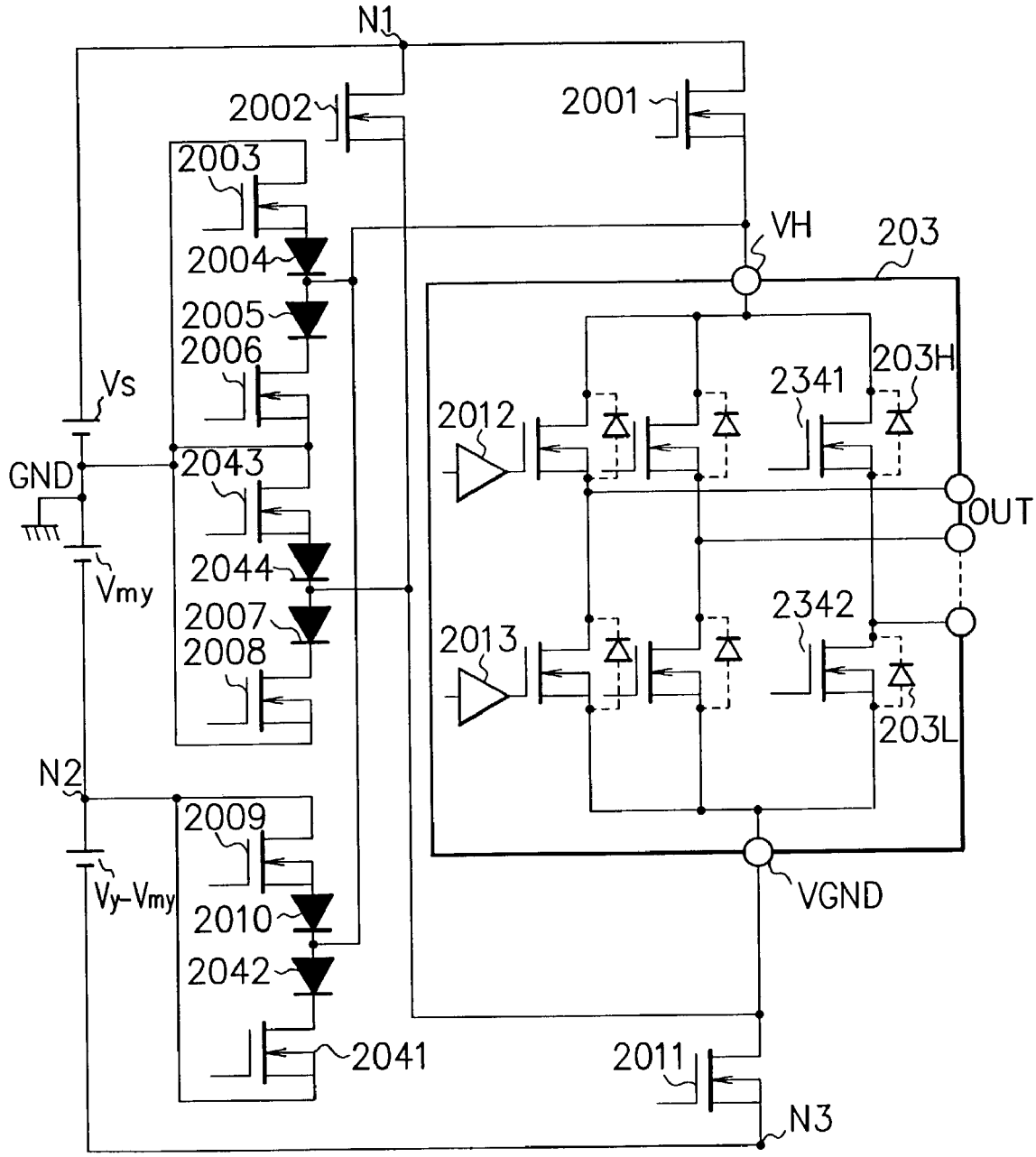
FIG. 4 is a circuit diagram showing an example of a Y electrode drive circuit including a scan drive module and a Y common driver.

FIG. 4 shows an example of a Y electrode drive circuit including the scan drive modules 203odd and 203even and the Y common drivers 204odd and 204even shown in FIG. 1. When the drive waveforms shown in FIG. 18 are actually applied to the plasma display panel, this Y electrode drive circuit is made to have high output impedance in the address period ADD. However, the Y electrode drive circuit and the X electrode drive circuit (the X common driver) of the lines to which the scan pulses are applied are driven at low output impedance.

Hereinafter, all or each of the scan drive modules 203odd and 203even will be referred to as a scan module 203. All or each of the Y common drivers 204odd and 204even will be referred to as a Y common driver 204. All or each of the X common drivers 206odd and 206even will be referred to as an X common driver 206.

First of all, a configuration of the scan drive module 203 will be explained. An n-channel MOSFET 2341 has a parasitic diode 203H, a gate connected to an output of a drive circuit 2012, a source connected to an output terminal OUT, and a drain connected to a power supply terminal VH. The parasitic diode 203H has an anode connected to the source of the MOSFET 2341 and a cathode connected to the drain of the MOSFET 2341. An n-channel MOSFET 2342 has a parasitic diode 203L, a gate connected to an output of a drive circuit 2013, a source connected to a reference terminal VGND, and a drain connected to the output terminal OUT. The parasitic diode 203L has an anode connected to the source of the MOSFET 2342 and a cathode connected to the drain of the MOSFET 2342. Although the circuit for the output terminal OUT of one bit has been explained above, circuits for output terminals of other bits have the same configuration.

Next, the Y common driver 204 will be explained. An n-channel MOSFET 2001 has a source connected to the power supply terminal VH and a drain connected to a node N1. An n-channel MOSFET 2011 has a source connected to a node N3 and a drain connected to the reference terminal VGND. An n-channel MOSFET 2002 has a source connected to the reference terminal VGND and a drain connected to the node N1. A power supply Vs has a positive pole connected to the node N1 and a negative pole connected to the ground GND. A power supply Vmy has a positive pole connected to the ground GND and a negative pole connected to a node N2. A power supply Vy−Vmy has a positive pole connected to the node N2 and a negative pole connected to the node N3.

An n-channel MOSFET 2003 has a drain connected to the ground GND and a source connected to an anode of a diode 2004. A cathode of the diode 2004 is connected to the power supply terminal VH. A diode 2005 has an anode connected to the power supply terminal VH and a cathode connected to a drain of an n-channel MOSFET 2006. A source of the MOSFET 2006 is connected to the ground GND.

An n-channel MOSFET 2043 has a drain connected to the ground GND and a source connected to an anode of a diode 2044. A cathode of the diode 2044 is connected to the reference terminal VGND. A diode 2007 has an anode connected to the reference terminal VGND and a cathode connected to a drain of an n-channel MOSFET 2008. A source of the MOSFET 2008 is connected to the ground GND.

An n-channel MOSFET 2009 has a drain connected to the node N2 and a source connected to an anode of a diode 2010. A cathode of the diode 2010 is connected to an anode of a diode 2042. An n-channel MOSFET 2041 has a drain connected to a cathode of the diode 2042 and a source connected to the node N2.

In the address period ADD (FIG. 18), all of the output terminals of the Y electrode drive circuit are brought to −Vmy level except an output (at output level −Vy) which is applying the scan pulse to a Y electrode line. When the voltage of the address electrode facing the Y electrodes in the plasma display panel lowers, the Y electrode drive IC 230 is made to have high output impedance as shown in FIG. 2 and FIG. 3 so that power consumption of the address driver 202 can be reduced. However, when the voltage of the address electrode rises, high output impedance cannot be maintained because an output current flows through the diode 203H connected in parallel to the high-side output element 2341 in the Y electrode drive IC which is mounted on the scan drive module 203, which may increase power consumption of the address drive circuit.

If the high-side output element 2341 is a MOSFET, the diode 203H connected in parallel corresponds to a parasitic diode between its drain and source. Even if the high-side output element 2341 is an IGBT (insulated gate bipolar transistor) or a bipolar transistor other than the MOSFET, the above-described concern remains because a parallel diode, which becomes necessary in other time than a scan operation mode, is generally added in a position of the diode 203H. Thus, in this case, among the drive elements in the Y common drivers 204, the drive element 2041 connected in series to the conductive diode 2042, which has the same direction as the parallel diode 203H to the output element 2341 in the scan drive module 203, is controlled to an interruption state at least when an address output rises in the address period ADD. Accordingly, output impedance of the Y electrode drive circuit is completely made to have high impedance in the address period ADD so that power consumption of the address driver 202 can be reduced maximally.

Also in a case of driving the electrodes under a condition in which the drive waveforms shown in FIG. 18 are formed, it may be difficult to maintain high output impedance because of outflow of the output current through the diode 203L which is connected in parallel to the low-side output element 2342. Also at this time, needless to say, it is effective to control the drive element 2043, which is connected to the conductive diode 2044 having the same direction in the Y common driver 204, to the interruption state.

As described above, the address driver 202 drives the address electrodes, the Y common driver 204 and the scan driver 203 drive the Y electrodes, and the X common driver 206 drives the X electrodes. The X electrodes and the Y electrodes are display discharge electrodes. Display discharge electrode drivers include the Y common driver 204, the scan driver 203, and the X common driver 206. The Y electrodes are scan discharge electrodes and the Y common driver 204 and the scan driver 203 are scan discharge electrode drivers.

When the address driver 202 drives the address electrodes, as shown in FIG. 2, the display discharge electrode driver is connected to drive all of a plurality of the display discharge electrodes, or interrupted so that output impedance rises. Further, as shown in FIG. 3, the display discharge electrode driver is connected to drive a part of a plurality of the display discharge electrodes, or interrupted so that output impedance is increased. At this time, the Y electrode drivers 203 and 204 bring the Y electrode to which the scan pulse is applied to a connection state and the Y electrodes to which the scan pulse is not applied to the connection state or an interruption state. The X common driver 206 controls each of the lines to the same state corresponding to the Y electrode drivers 203 and 204.

All or a part of the display discharge electrodes are controlled to the interruption state, thereby removing a parasitic capacitance between the display discharge electrode and the address electrode, which exists in the display panel, from the load capacitance of the address driver. With this effect of reducing the load capacitance, power consumption of the address driver can be reduced.

Second Embodiment

Figure 5:
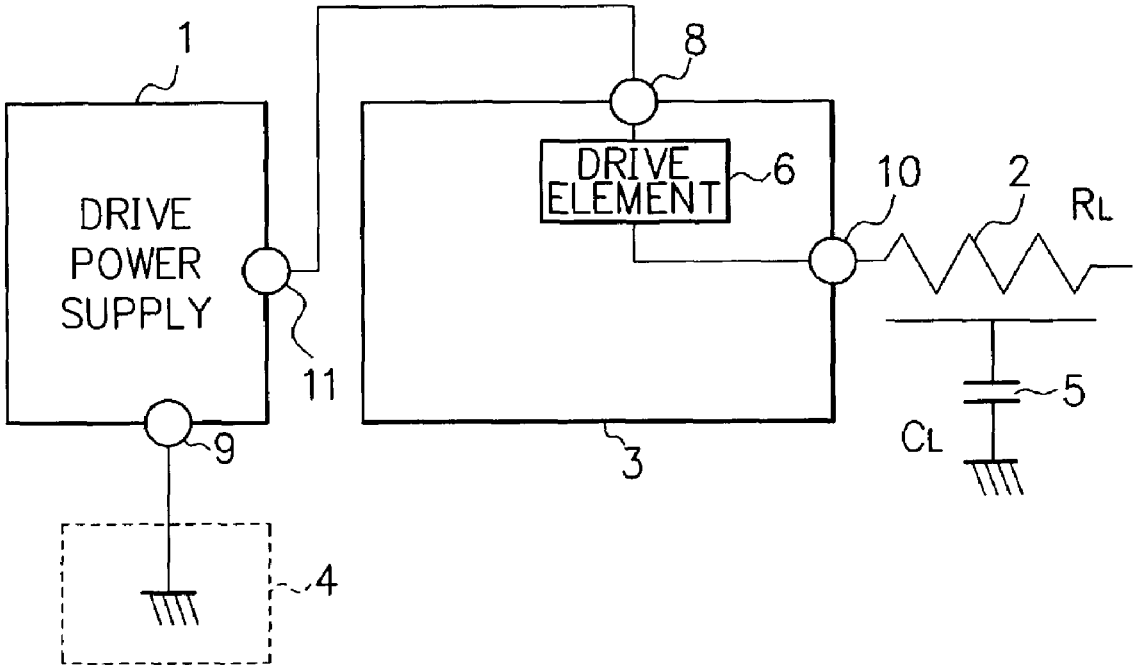
FIG. 5 is a view showing configuration of an address driver according to a second embodiment of the present invention.
Figure 21:
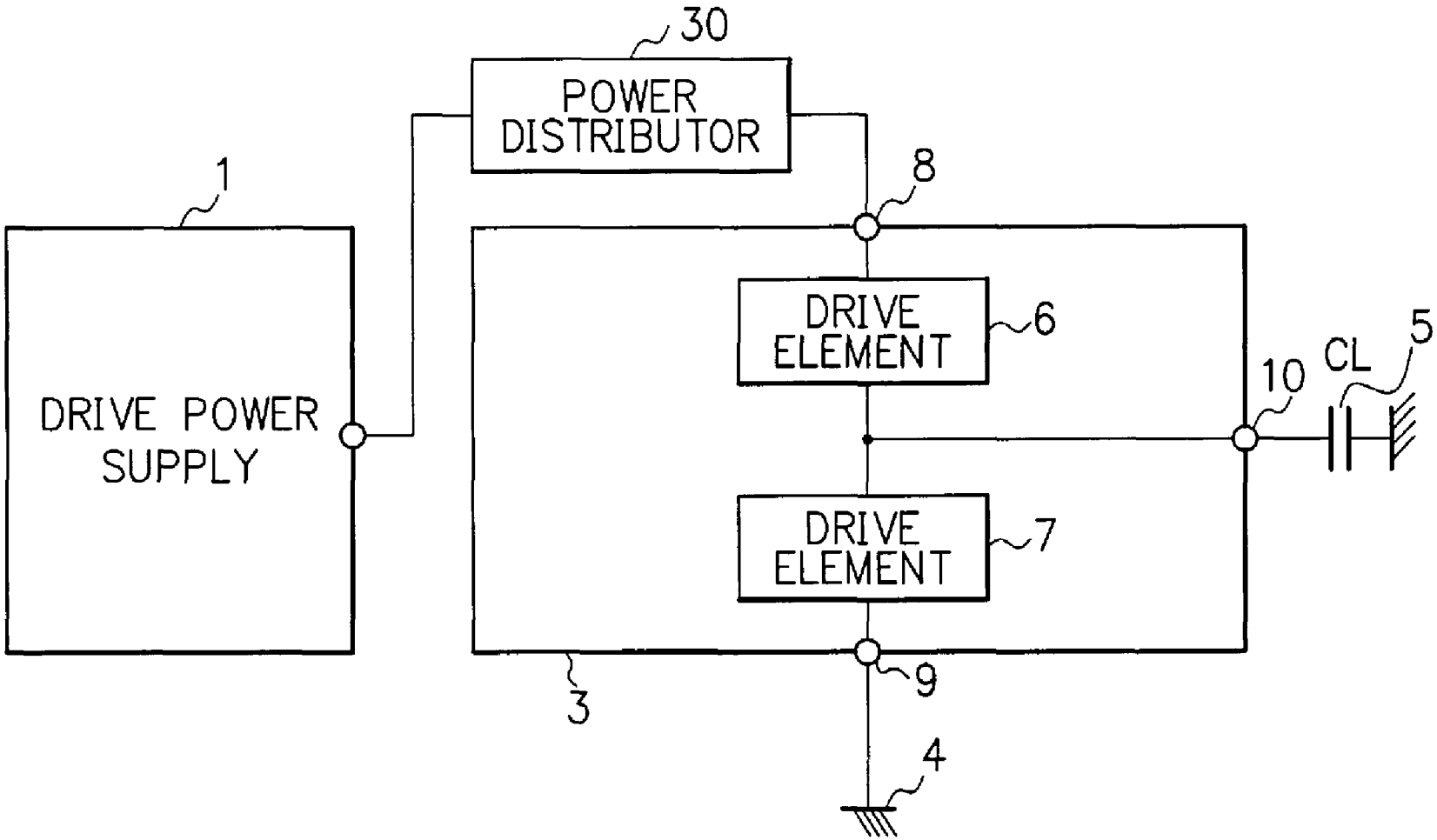
FIG. 21 is a block diagram showing one example of a drive circuit for a plasma display using a power distribution method.

FIG. 5 shows a configuration of the address driver 202 according to a second embodiment of the present invention. Although the two drive elements 6 and 7 are used in FIG. 21, a single drive element 6 is used in the address drive in FIG. 5 so that power consumption (heating) can be reduced while circuit costs are cut.

In a drive power supply 1, a reference terminal 9 is connected to a reference potential (ground) 4. A drive circuit 3 has the drive element 6, a power supply terminal 8 connected to a power supply terminal 11 of the drive power supply 1, and an output terminal 10 connected to the address electrode of the plasma display panel 201 (FIG. 1). A resistance 2 and a capacitance 5 are a resistance and a capacitance of the address electrode and have a resistance value RL and a capacitance value CL respectively.

Properly speaking, a load such as a drive electrode for a flat display panel like the plasma display panel has the structure in which a parasitic capacitance and a parasitic resistance are not concentrated but distributed. Here, when a resistance value between both ends of the distributed resistance 2 is RL, assuming that a current leaks uniformly from an output terminal 10 side to the parasitic capacitance 5 and becomes zero at a tip of the electrode, an effective electrode resistance value Ra becomes one third of the resistance value RL between both ends. The two elements 6 and 7 (FIG. 21) used in a general push-pull circuit configuration are not used but only the drive element 6 is used as a drive element in the drive circuit 3. Here, by using the single drive element or a combined circuit composed of the drive element and an additional element as the drive element 6, a switching function for a current of at least one direction and a bi-directional conducting function are realized.

On this occasion, a drive current, which flows when the circuit is driven by the drive circuit 3 in a direction of raising a voltage of the load capacitance 5 of the capacitance value CL, flows from the drive power supply to the distributed resistance 2, which shows the resistance value Ra, through the drive element 6 in the drive circuit 3. Further, a drive current, which flows when the voltage of the load capacitance 5 is lowered by lowering an output potential of the drive power supply 1 to lower a potential of the power supply terminal 8 of the drive circuit 3, flows into the reference potential 4 through the drive element 6 having a bi-directional conduction characteristic and the drive power supply 1. At this time, by reducing conduction impedance of the drive element 6 to be lower than output impedance of the drive power supply 1 and the above-described effective electrode resistance value RL, power consumption in the drive element 6 can be reduced. Power consumption in the drive element 6 can be further reduced by applying the power recovery circuit or a multistage raising/lowering circuit to the drive power supply 1 as described above.

Figure 6:
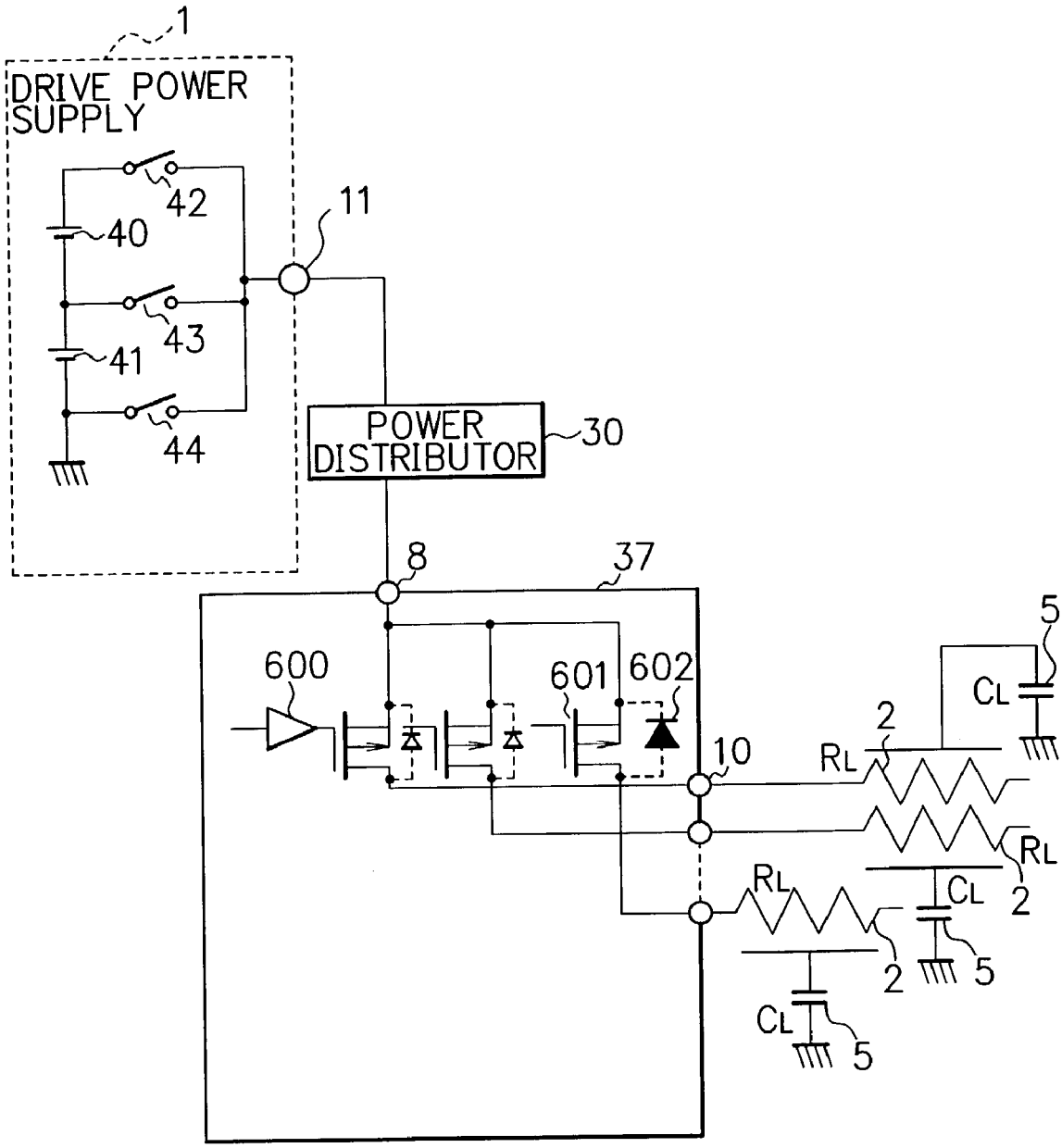
FIG. 6 is a view showing a more specific circuit of the address driver in FIG. 5.

FIG. 6 shows a more specific circuit of the address driver in FIG. 5. A drive IC 37 corresponds to the drive circuit 3 in FIG. 5. A power distributor 30 is a resistance, for example, and connected between a power supply terminal 8 of the drive IC 37 and a power supply terminal 11 of a drive power supply 1. Since the power distributor 30 is formed outside the drive IC 37, a heating value in the drive IC 37 can be reduced and costs for heatsinking of the drive IC 37 can be cut.

Next, a configuration of the drive power supply 1 will be explained. A power supply 41 has a positive pole connected to a negative pole of a power supply 40 and a negative pole connected to the ground. A switch 42 is connected between a positive pole of the power supply 40 and the power supply terminal 11. A switch 43 is connected between the negative pole of the power supply 40 and the power supply terminal 11. A switch 44 is connected between the ground and the power supply terminal 11.

Substantially, a configuration of the drive IC 37 will be explained. A p-channel MOSFET 601 has a parasitic diode 602, a gate connected to a drive circuit 600, a source connected to the power supply terminal 8, and a drain connected to an output terminal 10. The parasitic diode 602 has an anode connected to the drain of the MOSFET 601 and a cathode connected to the source of the MOSFET 601. The same number of the output terminals 10 as that of the address electrodes are prepared and connected to the address electrodes outside. Each of the address electrodes has a resistance 2 and a capacitance 5. Each of the output terminals 10 is connected to the same circuit as that described above.

Figure 7:
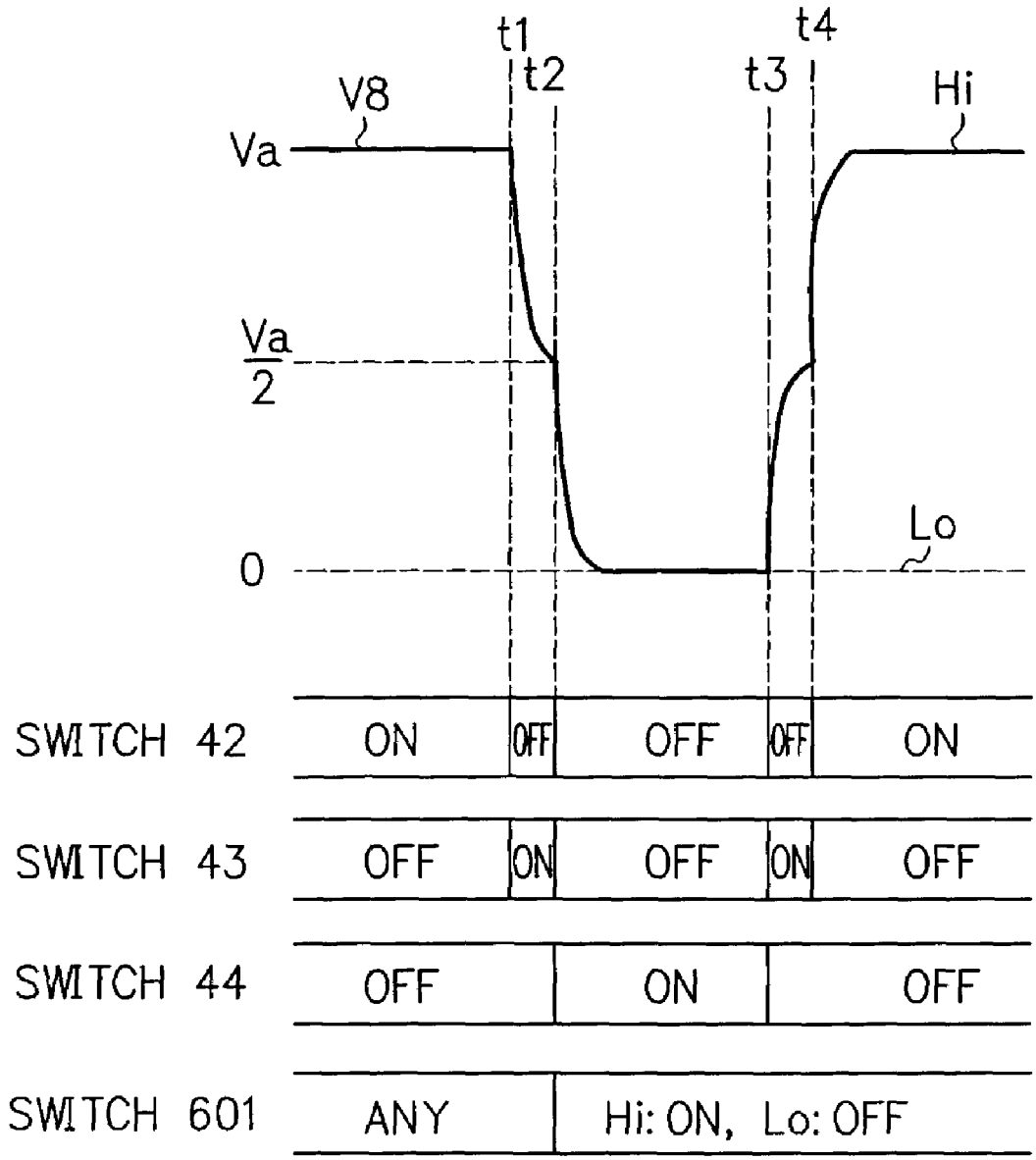
FIG. 7 is a chart showing an example of switch control and voltage waveforms corresponding thereto.

FIG. 7 shows an example of controlling the switches 42 to 44 and the switch (MOSFET) 601 and a waveform of a voltage V8. The voltage V8 is a voltage waveform of the power supply terminal 8.

Before a timing t1, the switch 42 is on and the switches 43 and 44 are off. The voltage V8 is at Va.

Next, at the timing t1, the switches 42 and 44 are turned off and the switch 43 is turned on. The voltage V8 lowers to Va/2.

Then, at a timing t2, the switches 42 and 43 are turned off and the switch 44 is turned on. The voltage V8 lowers to 0 V.

Subsequently, at a timing t3, the switches 42 and 44 are turned off and the switch 43 is turned on. The voltage V8 rises to Va/2.

Then, at a timing t4, the switch 42 is turned on and the switches 43 and 44 are turned off. The voltage V8 rises to Va.

The correlation between the switch (MOSFET) 601 and a voltage of the output terminal 10 will be next explained. Before the timing t2, the switch 601 can be either on or off. At and after the timing t2, when the switch 601 is turned on, a voltage Hi is outputted from the output terminal 10. The voltage Hi is the same as the voltage V8. On the other hand, when the switch 601 is turned off, a voltage Lo is outputted from the output terminal 10. The voltage Lo is 0 V. The voltage of the output terminal 10 corresponds to the voltage waveform of the address electrode in FIG. 18.

In FIG. 6, with the parasitic diode 602, the single drive element 601 in the drive IC 37 has a switching function for a current in a direction from the power supply terminal 8 to the output terminal 10 and a conducting function to a current in an opposite direction thereto. Although the p-channel MOSFET 601 is used as the drive element in FIG. 6, an n-channel MOSFET 603 on which a diode 602 is parasitic in the same manner can be also applied, as shown in FIG. 9. Moreover, as shown in FIG. 8C, an IGBT 608 to which a diode 609 is newly added in parallel, a bipolar transistor, or the like can be also used.

Figure 10:
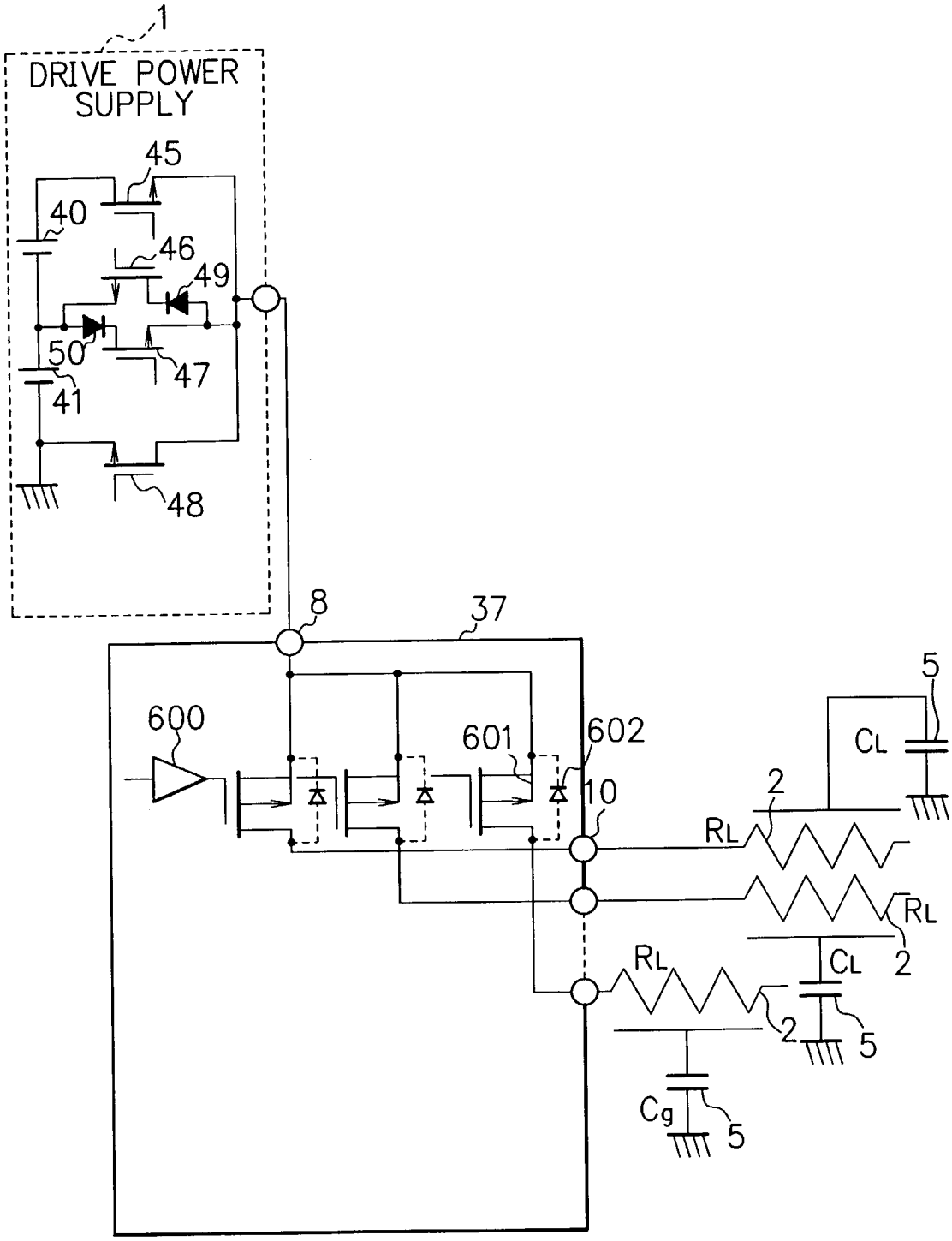
FIG. 10 is a view showing still another circuit example of the address driver in FIG. 6.

In FIG. 6, the drive IC 37 is driven by the drive power supply 1 having a two-stage voltage raising/lowering function via the power distributor 30, and a potential of the power supply terminal 8 changes within a range from the ground to an electrode drive voltage. FIG. 10 shows an example of a circuit configuration of the two-stage voltage raising/lowering circuit in the drive power supply 1.

In FIG. 10, a configuration of the drive power supply 1 will be explained. An n-channel MOSFET 45 corresponds to the switch 42 (FIG. 6) and has a source connected to the power supply terminal 11 and a drain connected to a positive pole of a power supply 40. An n-channel MOSFET 48 corresponds to the switch 44 (FIG. 6) and has a source connected to the ground and a drain connected to the power supply terminal 11.

Next, a configuration corresponds to the switch 43 (FIG. 6) will be explained. An n-channel MOSFET 46 has a source connected to a negative pole of the power supply 40 and a drain connected to a cathode of a diode 49. An anode of the diode 49 is connected to the power supply terminal 11. An n-channel MOSFET 47 has source connected to the power supply terminal 11 and a drain connected to a cathode of a diode 50. An anode of the diode 50 is connected to the negative pole of the power supply 40.

Since the MOSFETs described above in the drive power supply 1 have an on-resistance, they have a function of the power distributor 30 in FIG. 6.

Figure 11:
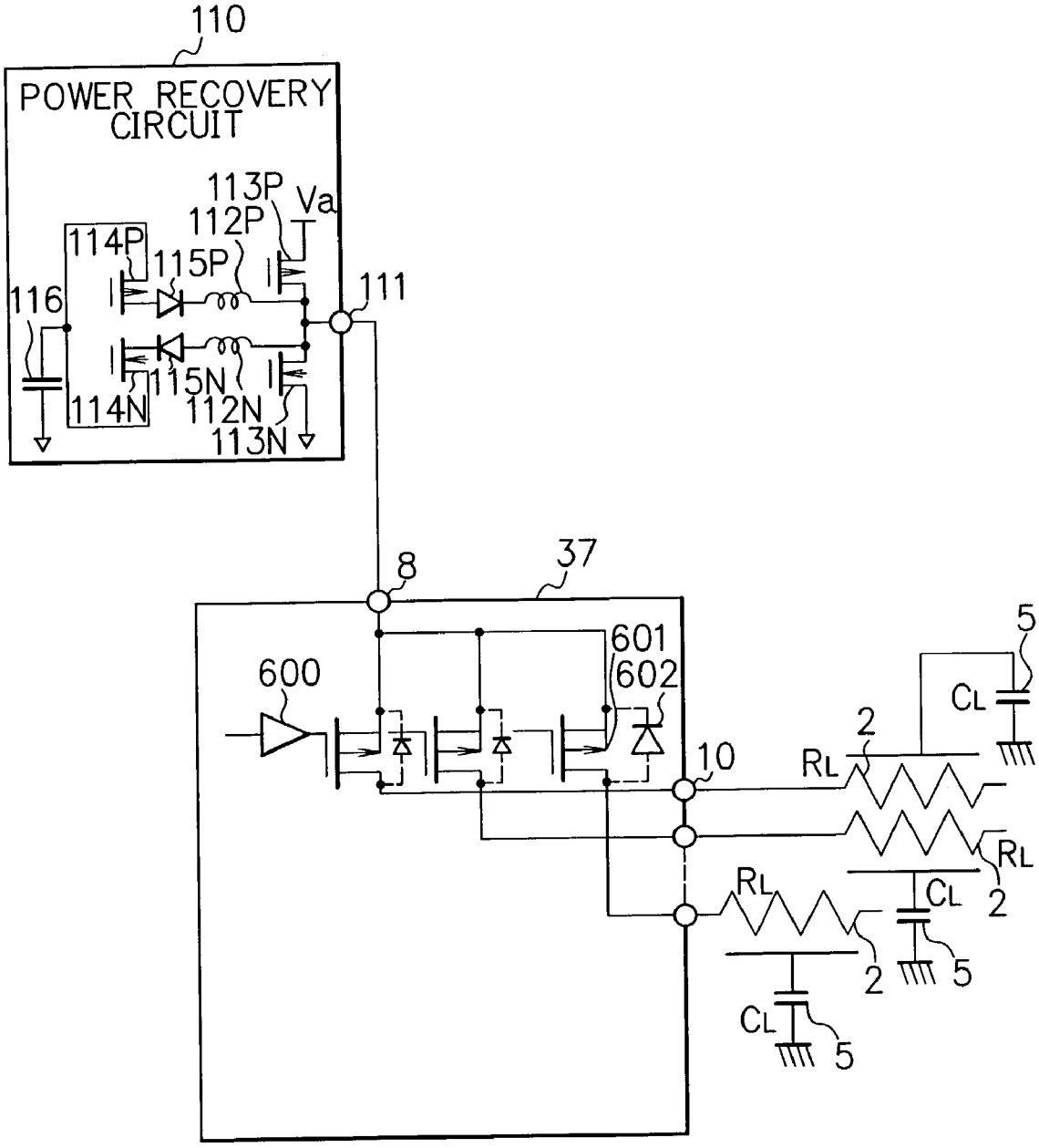
FIG. 11 is a view showing a configuration example of a drive power supply using a power recovery circuit.

FIG. 11 shows an example of a configuration of a drive power supply 110 using the power recovery circuit. The power recovery circuit can lower power consumption. A p-channel MOSFET 113P has a source connected to a positive potential Va and a drain connected to a power supply terminal 111. An n-channel MOSFET 113N has a source connected to the ground and a drain connected to the power supply terminal 111. An inductance 112P is connected between a cathode of a diode 115P and the power supply terminal 111. A p-channel MOSFET 114P has a drain connected to an anode of the diode 115P and a source connected to a first electrode of a capacitor 116. A second electrode of the capacitor 116 is connected to the ground. An inductance 112N is connected between an anode of a diode 115N and the power supply terminal 111. An n-channel MOSFET 114N has a drain connected to a cathode of the diode 115N and a source connected to the first electrode of the capacitor 116.

Subsequently, the operation of the drive power supply (the power recovery circuit) 110 will be explained. This drive power supply 110 can generate the same voltage as the voltage V8 in FIG. 7. Before a timing t1, the FET 113P is on and the FETs 113N, 114N, and 114P are off. At this time, the voltage V8 is at Va. Next, at the timing t1, the FET 114N is turned on and the FETs 113P, 113N, and 114P are turned off. At this time, due to an LC resonance of the inductance 112N and the capacitor 116, the capacitor 116 is charged and power is recovered so that the voltage V8 lowers. Then, at a timing t2, the FET 113N is turned on and the FETs 113P, 114P, and 114N are turned off. At this time, the voltage V8 becomes 0 V (ground). Next, at a timing t3, the FET 114P is turned on and the FETs 113P, 113N, and 114N are turned off. At this time, the voltage V8 rises. Then, at a timing t4, the FET 113P is turned on and the FETs 113N, 114P, and 114N are turned off. At this time, the voltage V8 becomes Va.

Figure 8A:
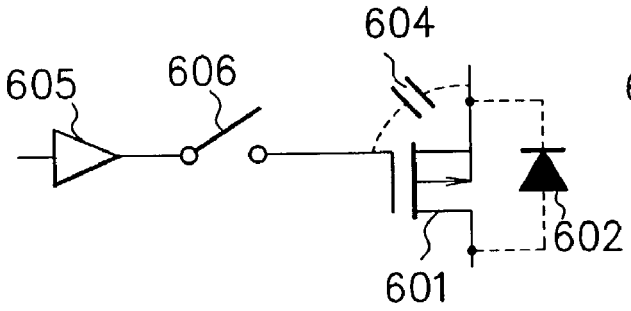
FIGS. 8A to 8C are views showing specific configurations of a drive circuit, MOSFETs, and diodes in FIG. 6.
Figure 8B:
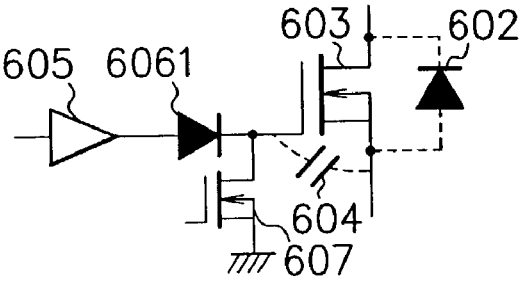
Figure 8C:
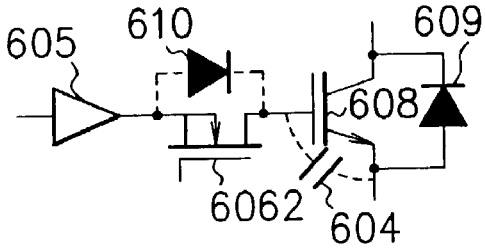
Figure 9:
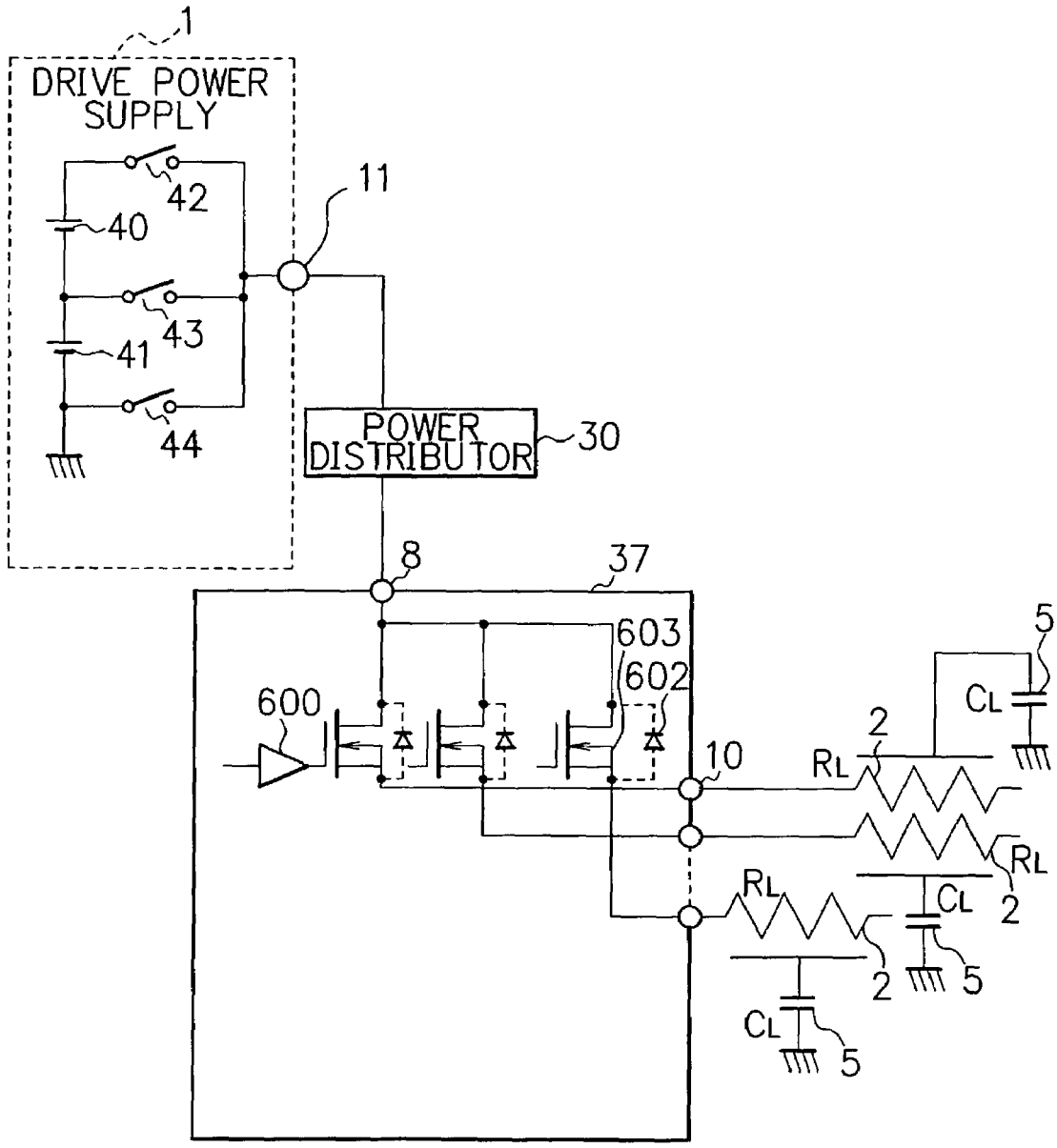
FIG. 9 is a view showing another circuit example of the address driver in FIG. 6.

FIGS. 8A to 8C show specific configurations of the drive circuit 600, the FET 601, and the diode 602 in FIG. 6. In FIG. 6, a high voltage circuit connected to the power supply terminal 8 is used as the drive circuit 600 in many cases in order to maintain the FET (the drive element) 601 in the conduction state and the interruption state at a wide-ranged potential. Thus, examples are shown in FIGS. 8A to 8C, in which the drive circuit 600 is constituted by a lower voltage circuit in order to reduce circuit costs of the drive circuit 600.

In FIG. 8A, a control voltage outputted from a drive circuit 605, which is composed of low cost and low breakdown voltage elements, is applied to a gate of the drive element 601 via a switching circuit 606. When a state of the drive element 601 is controlled by bringing the switching circuit 606 into conduction and thereafter the switching circuit 606 is interrupted, the control voltage is held in a parasitic capacitance 604 between the gate and a source, a pair of input terminals, so that the control of the drive element 601 is also maintained. In a case in which a voltage drive element whose input terminals are insulated is used as the drive element 601 as described above, the parasitic capacitance 604 between a pair of the input terminals can be used as a hold capacitor. This is based on the fact that, in the drive element 601, the parasitic capacitance 604 between a pair of the input terminals is generally designed to be significantly larger than the parasitic capacitance between other pairs of the input terminals in order to stabilize the operation and to lower power consumption.

The configuration in FIG. 8B will be explained. An n-channel MOSFET (a drive element) 603 has a parasitic diode 602. The parasitic diode 602 has an anode connected to a source of the FET 603 and a cathode connected to a drain of the FET 603. In place of the switching circuit 606 in FIG. 8A, a diode 6061 and an n-channel MOSFET 607 are used.

An output of a drive circuit 605 is brought to high level (5 V, for example) at the timing when a potential (the same potential as a potential of a source terminal of the drive element 603) of the output terminal 10 of the drive IC 37 has lowered to the ground level so that the drive element 603 becomes in the conduction state. Thereafter, when the output terminal 10 becomes at a high potential, the diode 6061 is interrupted and the conduction state of the drive element 603 is maintained. In interrupting the drive element 603, the drive element 607 is brought into conduction. A parasitic capacitance 604 between a pair of input terminals functions as a hold capacitor.

In FIG. 8C, the IGBT 608 to which the parallel diode 609 is added is used as a drive element as well as only an n-channel MOSFET 6062 is used as the aforesaid switching circuit. The FET 6062 has a parasitic diode 610. The operation of the FET (the switching circuit) 6062 is to bring the drive element 608 into conduction via the parasitic diode 610 of the n-channel MOSFET 6062 when an output of the drive circuit 605 is at high level. Further, the output of the drive circuit 605 is brought to low level as well as a gate potential of the n-channel MOSFET 6062 is brought to high level so that the drive element 608 is interrupted. A parasitic capacitance 604 between a pair of input terminals functions as a hold capacitor.

It is needless to say that any combination of each of the circuit configurations in FIGS. 8A to 8C is possible and a drive element of a reverse polarity can be applied in accordance with the drive waveforms.

As stated above, in FIG. 6, the drive power supply 1 can supply the voltage which rises/lowers cyclically. The FET 601 and the parasitic diode 602 compose a first switching element. The first switching element is connected between the drive power supply 1 and the output terminal 10, is capable of bi-directional conduction, and has a switching function for a current of at least one direction.

By using the above-described circuit having the switching function for the current of at least one direction and the bi-directional conducting function, a plurality of the drive elements, which have been provided for each of the output terminals 10*a* for constituting a push-pull, are reduced to one so that circuit costs can be cut.

Further, as shown in FIG. 8A, the first switching element is a high voltage switching element, and a control terminal of the first switching element is connected to the low voltage drive circuit 605 via a second switching element 606 or the like. Moreover, as shown in FIGS. 8B and 8C, the second switching element may be constituted by the diode 6061 or the MOSFET 6062.

Third Embodiment

Figure 12A:
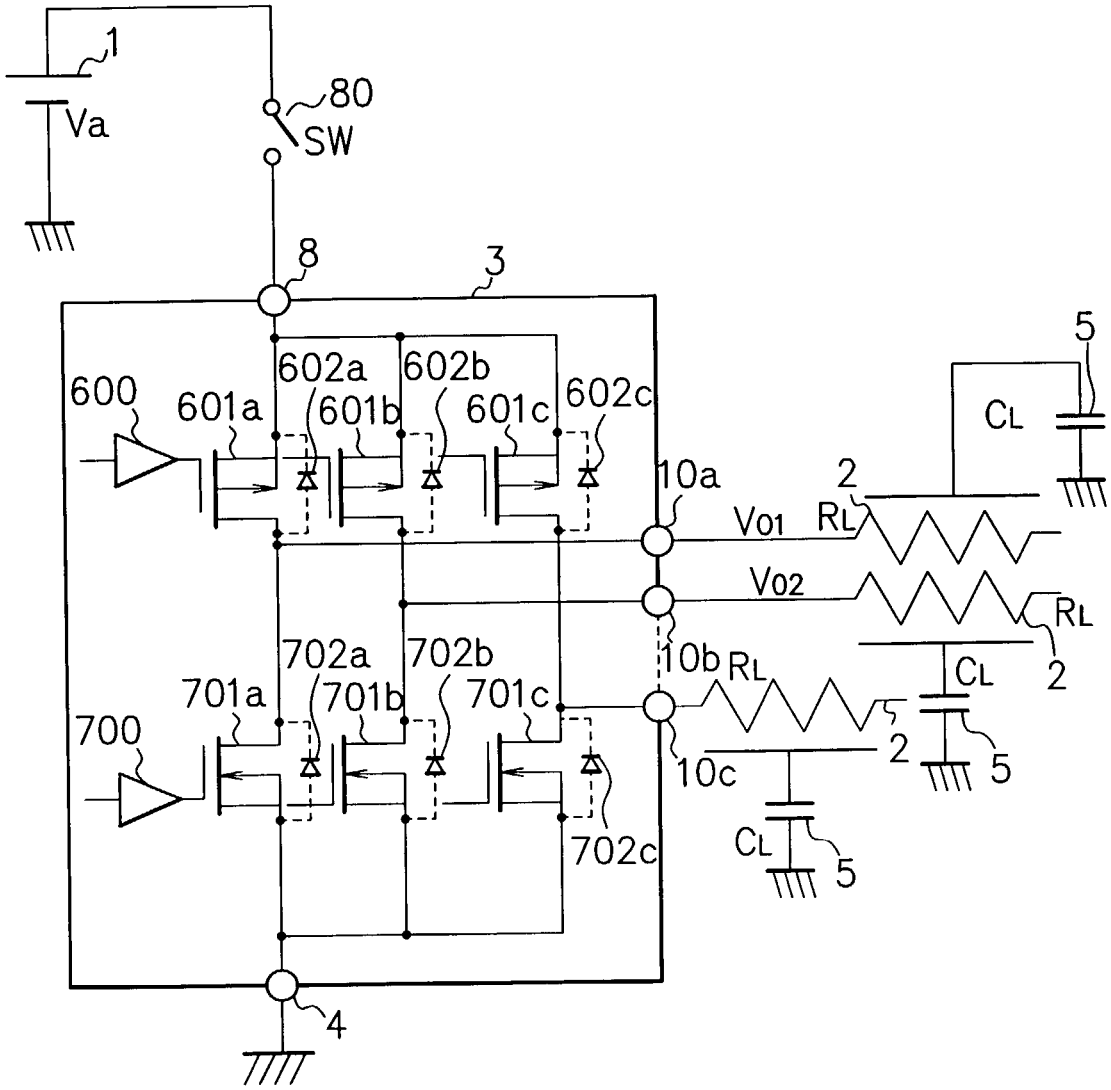
FIGS. 12A and 12B are a view showing a configuration example of an address driver and waveforms thereof, according to a third embodiment of the present invention.

FIG. 12A shows a configuration example of the address driver 202 (FIG. 1) according to a third embodiment of the present invention. This address driver 202 can reduce power consumption by reusing electric charge, which is charged in a load capacitance, when output is changed over.

A power supply terminal 8 of a drive circuit 3 is connected to a drive power supply 1 via a switching circuit 80. P-channel MOSFETs 601*a*, 601*b*, and 601*c* have parasitic diodes 602*a*, 602*b*, and 602*c* respectively, sources connected to the power supply terminal 8, and drains connected to output terminals 10*a*, 10*b*, and 10*c* respectively. Anodes and cathodes of the parasitic diodes 602*a* to 602*c* are connected to drains and sources of the FETs 601*a* to 601*c* respectively. Gates of the FETs 601*a* to 601*c* are connected to an output of a drive circuit 600.

N-channel MOSFETs 701*a*, 701*b*, and 701*c* have parasitic diodes 702*a*, 702*b*, and 702*c* respectively, sources connected to a ground terminal 4, and drains connected to the output terminals 10*a*, 10*b*, and 10*c* respectively. Anodes and cathodes of the parasitic diodes 702*a* to 702*c* are connected to sources and drains of the FETs 701*a* to 701*c* respectively. Gates of the FETs 701*a* to 701*c* are connected to an output of a drive circuit 700. To the output terminals 10*a* to 10*c*, resistances 2 and capacitances 5 of address electrodes are connected.

The drive circuit 3 may be a single drive IC or a drive module on which a plurality of the drive ICs are mounted or a drive circuit including a plurality of the drive modules only if the circuit has a plurality of the output terminals 10*a* to 10*c*.

Figure 12B:
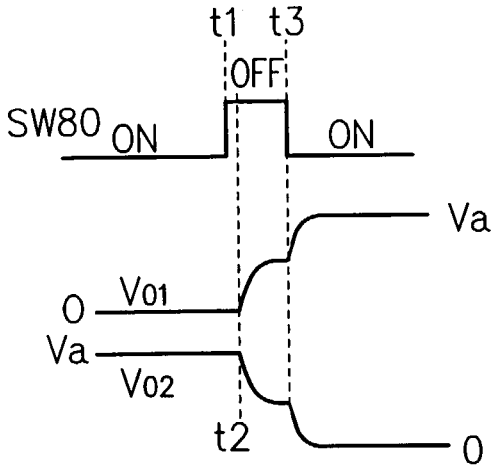

A chart of waveforms in FIG. 12B shows a state of the switch 80 and waveforms of a voltage Vo1 of the output terminal 10*a* and a voltage Vo2 of the output terminal 10*b*. As an example, a case will be explained in which the voltage Vo1 is raised from 0 V to Va and the voltage Vo2 is lowered from Va to 0 V.

Before a timing t1, the switch 80 is on, the FETs 601*b* and 701*a* are on (conducted), and the FETs 701*b* and 601*a* are off (interrupted). The voltage Vo1 is 0 V and the voltage Vo2 is at Va.

Then, at the timing t1, the switch 80 is turned off.

Next, at a timing t2, the FET 701*a* as a low-side output terminal is turned off. Thereafter, the FET 601*a* as a high-side output element is turned on and the FET 601*b* is turned off. At this time, the voltage Vo2 of the output terminal 10*b* is supplied to the output terminal 10*a* via the parasitic diode 602*b* and the FET 601*a*. The voltage Vo2 lowers, the voltage Vo1 rises, and both become the same voltage in a short time. On this occasion, by distributing electric charge stored in the load capacitance 5 of the output terminal 10*b* to the load capacitance of the output terminal 10*a*, an amount of electric charge subsequently supplied from the drive power supply 1 is reduced so that power consumption can be reduced.

Next, at a timing t3, the switch 80 is turned on and the FET 701*b* as a low-side output element is turned on. At this time, the voltage Vo1 rises to Va and the voltage Vo2 lowers to 0 V.

In this case, the drive circuits 600 and 700 are controlled to change over the FETs 601*a* and 601*b* as the high-side output elements and the FET 701*a* as the low-side output element to be turned off at the timing t2, and thereafter change over the FET 701*b* as the low-side output element to be turned on at the timing t3. For example, in the drive circuit 700 of the FET 701*b*, a CR delay circuit composed of a resistance and a capacitor is provided in a control signal path or drive capability of an active element is restricted so that longer propagation delay time than that of the drive circuits 600 and 700 of the FETs 601*a*, 601*b*, and 701*a* can be secured.

Further, the switch 80 is designed to be off from the timing t1 to t3. This design can be also easily created with the respective timing signals inputted to the control circuit 205 shown in FIG. 1. The switch 80 is thus kept off so that electric charge charged in each of the load capacitances can be collected and distributed to the output terminals which are to be at high level. Thereafter, when the switch 80 is conducted, the amount of electric charge supplied from the drive power supply 1 can be reduced by the amount of the above-described distributed electric charge, which reduces supplied energy from the drive power supply 1, thereby reducing power consumption of the drive circuit 3.

Incidentally, the switching circuit 80 provided between the drive power supply 1 and the drive circuit 3 can be provided between a ground potential of the ground terminal 4 and the drive circuit 3.

Figure 13:
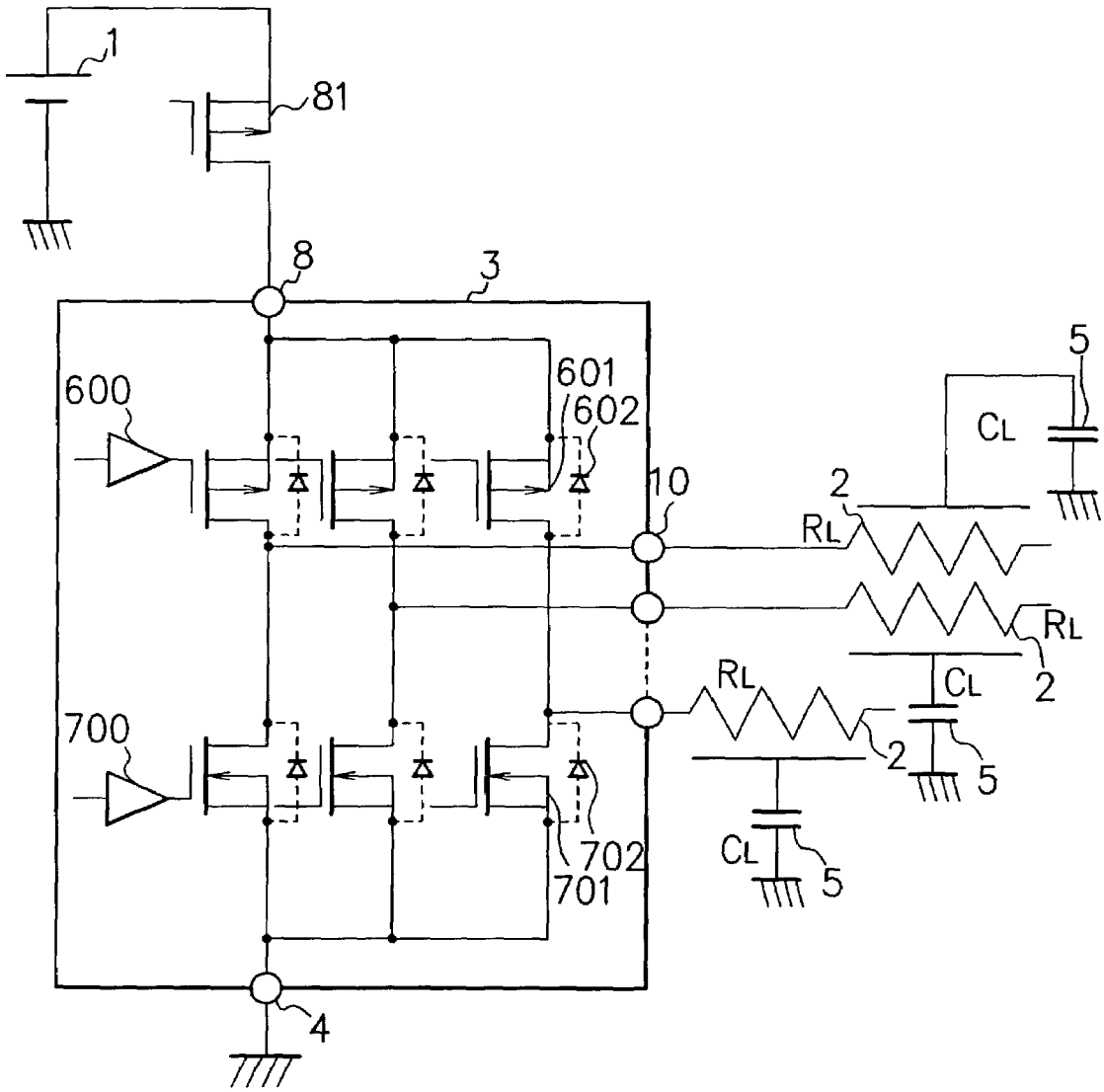
FIG. 13 is a view showing an example of constituting a switch in FIG. 12A by a MOSFET.

FIG. 13 shows an example in which the switch 80 in FIG. 12A is constituted by a MOSFET 81. It is needless to say that the MOSFET 81 may be of an n-channel or a p-channel type, or may be another switching element. It is also possible to use the MOSFET 81 in a constant current mode or a high output impedance state by suitably adjusting a drive voltage between a gate and a source of the MOSFET 81, or the like. With such drive, an effect of power distribution to the MOSFET 81 becomes large and further reduction in power consumption of the drive circuit 3 becomes possible.

As stated above, in FIG. 12A, a common switching element 80 is connected to the power supply 1. A first switching element 601*a* and 602*a* and a second switching element 701*a* and 702*a* are connected in series between the power supply 1 and the reference potential 4 via the common switching element 80. A first output terminal 10*a* is connected between the first switching element 601*a* and 602*a* and the second switching element 701*a* and 702*a*.

A third switching element 601*b* and 602*b* and a fourth switching element 701*b* and 702*b* are connected in parallel to the first switching element 601*a* and 602*a* and the second switching element 701*a* and 702*a*, and in series between the power supply 1 and the reference potential 4 via the common switching element 80. A second output terminal 10*b* is connected between the third switching element 601*b* and 602*b* and the fourth switching element 701*b* and 702*b*.

In FIG. 12B, the voltage of the reference potential 4 is outputted from the first output terminal 10*a* via the second switching elements 701*a* and 702*a* before the timing t1. Then, the common switching element 80 is opened at the timing t1, and the voltage of the second output terminal 10*b* is outputted from the first output terminal 10*a* via the first switching elements 601*a* and 602*a* and the third switching element 601*b* and 602*b* at the timing t2. Thereafter, the voltage of the power supply 1 is outputted from the first output terminal 10*a* via the common switching element 80 and the first switching element 601*a* and 602*a* at the timing 3.

Further, the voltage of the power supply 1 is outputted from the second output terminal 10*b* via the common switching element 80 and the third switching element 601*b* and 602*b* before the timing t1. Then, the common switching element 80 is opened at the timing t1, and the voltage of the first output terminal 10*a* is outputted from the second output terminal 10*b* via the first switching element 601*a* and 602*a* and the third switching element 601*b* and 602*b* at the timing t2. Thereafter, the voltage of the reference potential 4 is outputted from the second output terminal 10*b* via the fourth switching element 701*b* and 702*b* at the timing t3.

With the control described above, electric charge charged in the load capacitances can be reused when the outputs are changed over. This can reduce energy supplied from the power supply when the outputs are changed over and lower power consumption of the drive circuit.

Fourth Embodiment

Figure 14:
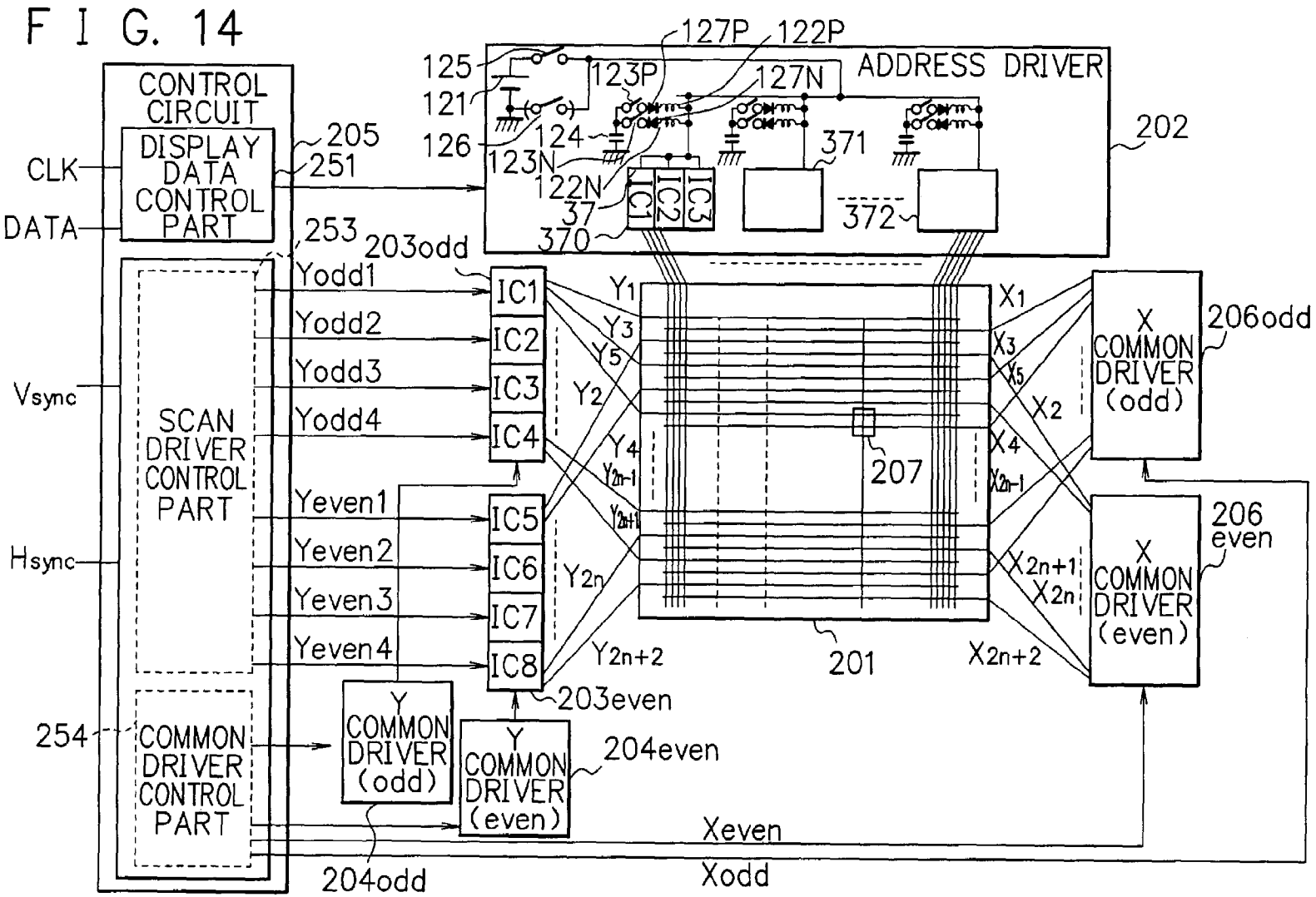
FIG. 14 is a view showing a configuration example of an address driver according to a fourth embodiment of the present invention.

FIG. 14 shows a configuration example of an address driver 202 according to a fourth embodiment of the present invention. This address driver 202 includes a power recovery circuit which does not significantly lose an effect of reducing power consumption even if higher resolution or larger-size screen is applied to the display panel.

The address driver 202 has address drive modules 370, 371, and 372 each of which includes a plurality of drive ICs 37. For each of the address drive modules 370, 371, and 372, provided is a resonant circuit part composed of resonant inductances 122P and 122N, resonant switches 123P and 123N, and an alternating ground capacitor 124. A plurality of the address drive modules 370 to 372 share only one switch circuit 125 for connecting to a drive power supply 121 of an output voltage.

The inductance 122P (the inductance 112P in FIG. 11) is connected between a power supply terminal of the address drive module 370 or the like and a cathode of a diode 127P (the diode 115P in FIG. 11). The switch 123P (the FET 114P in FIG. 11) is connected between an anode of the diode 127P and a first electrode of the capacitor 124. A second electrode of the capacitor 124 is connected to the ground.

The inductance 122N (the inductance 112N in FIG. 11) is connected between the power supply terminal of the address drive module 370 or the like and an anode of a diode 127N (the diode 115N in FIG. 11). The switch 123N (the FET 114N in FIG. 11) is connected between a cathode of the diode 127N and the first electrode of the capacitor 124.

The switch 125 (the FET 113P in FIG. 11) is connected between a power supply terminal of the drive power supply 121 and the power supply terminal of the address drive module 370 or the like. A reference terminal of the drive power supply 121 is connected to the ground. A switch 126 (the FET 113N in FIG. 11) is connected between the reference terminal of the drive power supply 121 and the power supply terminal of the address drive module 370 or the like.

As shown in the drawing, since the resonant circuit parts are formed closely to the address drive modules 370 to 372, wire length of a resonant current path is lessened to the shortest so that parasitic inductances and parasitic capacitances can be reduced. This makes it possible to perform high-speed drive with a reduced resonance cycle and to lower power consumption as a result of the improvement in power recovery efficiency caused by the increase in a Q value.

Further, in a case of desirably shortening the resonance cycle or reducing circuit parts, it is also suitable that the above-described resonant inductances 122P and 122N are removed and resonance is produced through the use of parasitic inductances distributed to the aforesaid wire of the resonant current path. At this time, the wire as the resonant current path can be constituted by a distributed constant circuit which uses a flat conductor pattern such as a printed substrate.

Furthermore, with the above-described single pair of the switching circuits 125 and 126 for fixing a potential which have small effects on a resonance characteristic, circuit costs can be reduced maximally. The resonant circuit part is provided for each of the drive ICs so that the drive speed can be maximized as well as power consumption is reduced maximally. Moreover, in a case in which only the maximum power consumption should be reduced to cut heating costs and substantial reduction in average power consumption is not necessary, further reduction in circuit costs is possible by eliminating the switching circuit 126 for fixing the potential to the ground.

As stated above, a first switching element 125 and 126 is connected to the power supply 121. In FIG. 11, the drive IC 37 has a plurality of second switching elements 601 and 602 connected between the power supply 110 and a plurality of the output terminals 10 respectively. In FIG. 14, the resonant circuit is provided for each one or plurality of the second switching elements, and includes the resonant inductances 122P and 122N and the capacitor 124 which are connectable to the reference potential. The larger number of the resonant circuits than that of the first switching element 125 and 126 are provided.

The magnitude of parasitic inductance on a connection wire from the output terminal 10 to the resonant inductances 122P and 122N is desirably smaller than that of the resonant inductances 122P and 122N. The resonant inductances 122P and 122N can be constituted by parasitic inductance on a wire from the output terminal 10 to the resonant current path in the resonant circuit.

A plurality of the resonant circuits are provided for each of the drive elements or the drive circuits (one or plurality of the second switching elements) so that wire length of the resonant circuit is lessened to the shortest and parasitic inductance of the resonant current path can be reduced. This realizes high-speed drive with a reduced resonance cycle and reduction in power consumption as a result of the improvement in recovery efficiency caused by the increase in the Q value. Further, by reducing the number of the above-described switching circuits 125 and 126 for fixing the power supply potential which have small effects on resonance, circuit costs can be cut.

According to the first to fourth embodiments described above, power consumption (heating) in the display panel drive circuit can be reduced as well as circuit costs can be prevented from increasing. Further, it is possible to advance reduction in size, power consumption, and costs of a plasma display of a 40-size (inch) or larger class having a large load capacitance, a high resolution plasma display such as SVGA (800×600 dots), XGA (1024×768 dots), or SXGA (1280×1024 dots) having a high address electrode drive pulse rate, and a high brightness and high gradation plasma TV such as TV, HDTV, or the like. Furthermore, it is also possible to prevent the increase in power consumption caused by the increase in the address electrode drive pulse rate as a result of a countermeasure taken against false contours in moving image display.

The display panel drive circuit described above can be applied to a flat display panel of a plasma display, an electroluminescence display, a liquid crystal display (LCD), and the like, and other displays.

As described above, since all or a part of the second electrodes are controlled to the interruption state, the parasitic capacitance existing in the display panel can be removed from a load capacitance of a first drive circuit. With this effect of reducing the load capacitance, power consumption of the first drive circuit can be reduced.

Further, the first switching element has the switching function for the current of at least one direction and the bi-directional conducting function so that the number of the switching elements can be reduced and circuit costs can be cut.

Furthermore, with the control by the control circuit, electric charge charged in the load capacitance which is connected to a second output terminal can be reused when output is changed over from the second output terminal to a first output terminal. This reduces energy supplied from the power supply when the output is changed over, thereby reducing power consumption.

In addition, the resonant circuit is provided for each one or plurality of the second switching elements so that wire length of the resonant circuit is shortened and parasitic inductance of the resonant current path can be reduced. This realizes high-speed drive with a reduced resonance cycle and reduction in power consumption as a result of the improvement in power recovery efficiency caused by the increase in the Q value.

Incidentally, the present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A display panel drive circuit, comprising:

a display panel comprising a plurality of first electrodes and second electrodes;

a first drive circuit for driving said first electrodes; and a second drive circuit for driving at least one of said second electrodes having a low output impedance state by connecting said second electrode to a selected potential and a high output impedance state by disconnecting said second electrode from the selected potential, wherein said second electrode is brought to the high output impedance state during a driving period for which at least said first drive circuit drives to change a potential of said first electrode, except the driving period of said second electrode.

2. The display panel drive circuit according to claim 1, wherein said first drive circuit is an address electrode drive circuit of a plasma display panel and said second drive circuit is a drive circuit for display discharge electrodes of the plasma display panel.

3. The display panel drive circuit according to claim 2, wherein said second drive circuit is a drive circuit for the display discharge electrodes of odd-numbered lines or of the plasma display panel.

4. The display panel drive circuit according to claim 2, wherein the display discharge electrodes include plural pairs of first and second display discharge electrodes for performing discharge; and said second drive circuit is a circuit for driving the first and second display discharge electrodes.

5. The display panel drive circuit according to claim 1, wherein said first drive circuit is an address electrode drive circuit of a plasma display panel and said second drive circuit is a drive circuit for scan discharge electrodes of the plasma display panel.

6. The display panel drive circuit according to claim 5, wherein said second drive circuit is a drive circuit for the scan discharge electrodes of odd-numbered lines or of the plasma display panel.

7. The display panel drive circuit according to claim 5, wherein said second drive circuit comprises one or plural drive ICs.

8. The display panel drive circuit according to claim 5, wherein said second drive circuit brings a first scan discharge electrode, to which a scan pulse is applied, to the low output impedance state and a second scan discharge electrode, to which the scan pulse is not applied, to the high output impedance state.

9. The display panel drive circuit according to claim 2, wherein said second drive circuit is a drive circuit for the display discharge electrodes of even-numbered lines of the plasma display panel.

10. The display panel drive circuit according to claim 5, wherein said second drive circuit is a drive circuit for the scan discharge electrodes of even-numbered lines of the plasma display panel.

11. The display panel drive circuit according to claim 8, wherein:

said second drive circuit brings the first scan discharge electrode, to which a scan pulse is applied, to the low output impedance state by connecting the first scan discharge electrode to a first potential, the second scan discharge electrode, not adjacent to the first scan discharge electrode and to which the scan pulse is not applied, to the high output impedance state, and a third scan discharge electrode, adjacent to the first scan discharge electrode to which the scan pulse is not applied, to the low output impedance state by connecting the third scan discharge electrode to a second potential.

12. The display panel drive circuit according to claim 1, wherein said second drive circuit comprises a drive element for connecting said second electrode to potential.

13. A plasma display comprising:

a plasma display panel, with a plurality of X electrodes and Y electrodes, which are parallel and adjacent to each other;

a plurality of address electrodes intersecting said X electrodes and said Y electrodes;

an X electrode drive circuit driving said X electrodes;

an address electrode drive circuit driving said address electrodes; and a Y electrode drive circuit driving said Y electrodes having a low output impedance state, by connecting to said Y electrode to a selected potential, and a high output impedance state, by disconnecting said Y electrode from the selected potential, wherein, during at least part of an address period, of selecting a display cell by an address pulse driving said address electrode and a scan pulse scanning and driving said Y electrode, except a period driven by said scan pulse, said Y electrode is brought to the high output impedance state by said Y electrode drive circuit.

* * * * *